US010276973B2

(12) United States Patent
Hashiguchi

(10) Patent No.: US 10,276,973 B2
(45) Date of Patent: Apr. 30, 2019

(54) CONNECTOR

(71) Applicant: JAPAN AVIATION ELECTRONICS INDUSTRY, LIMITED, Shibuya-ku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/159,472

(22) Filed: Oct. 12, 2018

(65) Prior Publication Data

US 2019/0044279 A1 Feb. 7, 2019

Related U.S. Application Data

(62) Division of application No. 15/871,309, filed on Jan. 15, 2018, now Pat. No. 10,141,687.

(30) Foreign Application Priority Data

Mar. 23, 2017 (JP) ..... 2017-057620

(51) Int. Cl.
*H01R 13/62* (2006.01)
*H01R 13/627* (2006.01)
(Continued)

(52) U.S. Cl.
CPC ..... *H01R 13/6272* (2013.01); *H01R 13/502* (2013.01); *H01R 13/6271* (2013.01);
(Continued)

(58) Field of Classification Search
CPC ..... H01R 13/6272; H01R 13/629; H01R 13/641; H01R 13/502; H01R 13/639; H01R 13/6271; H01R 24/20; H01R 24/28
(Continued)

(56) References Cited

U.S. PATENT DOCUMENTS 7,614,904 B2 * 11/2009 Hiramatsu ..... H01R 13/641 439/352
7,632,130 B2 12/2009 Sami
(Continued)

FOREIGN PATENT DOCUMENTS

EP 2053702 A2 4/2009
JP 2009032587 A 2/2009

OTHER PUBLICATIONS

Extended European Search Report dated Jul. 18, 2018 issued in counterpart European Application No. 18152597.3.

*Primary Examiner* — Jean F Duverne
(74) *Attorney, Agent, or Firm* — Holtz, Holtz & Volek PC

(57) ABSTRACT

A connector comprises a housing, a slider, a regulating portion and an operation portion. The housing has a lock portion. The slider has a release portion and a regulated portion. Under a mated state where the connector is mated with a mating connector having a mating lock portion, the lock portion locks the mating lock portion of the mating connector, and the regulating portion faces the regulated portion and regulates a rearward movement of the slider. When the operation portion is operated to be pressed inward of the connector, at least one of the regulating portion and the regulated portion is moved, and the regulating portion does not regulate the rearward movement of the slider. When the slider is moved rearward, the release portion moves the lock portion and releases the mating lock portion.

12 Claims, 16 Drawing Sheets

(51) Int. Cl.

| | |
|---|---|
| ***H01R 13/639*** | (2006.01) |
| ***H01R 13/502*** | (2006.01) |
| *H01R 103/00* | (2006.01) |
| *H01R 24/28* | (2011.01) |
| *H01R 24/20* | (2011.01) |

(52) U.S. Cl.
CPC ..... *H01R 13/639* (2013.01); *H01R 24/20* (2013.01); *H01R 24/28* (2013.01); *H01R 2103/00* (2013.01)

(58) Field of Classification Search
USPC ..... 439/310
See application file for complete search history.

(56) References Cited

U.S. PATENT DOCUMENTS

| | | | | |
|---|---|---|---|---|
| 8,634,901 | B2 | 1/2014 | Callahan et al. | |
| 8,668,651 | B2 | 3/2014 | Burnes et al. | |
| 8,690,611 | B2 | 4/2014 | Selvitelli et al. | |
| 8,876,543 | B2 | 11/2014 | Oka et al. | |
| 9,048,574 | B2 * | 6/2015 | Hiramatsu | H01R 13/6272 |
| 9,172,187 | B2 * | 10/2015 | Miyakawa | H01R 13/629 |
| 9,425,549 | B2 * | 8/2016 | Sekino | H01R 13/6272 |
| 9,543,698 | B2 | 1/2017 | Tanigawa | |
| 2009/0111312 | A1 | 4/2009 | Nakata et al. | |
| 2013/0303014 | A1 * | 11/2013 | Takagi | H01R 13/6275 439/350 |
| 2014/0273588 | A1 | 9/2014 | Toratani et al. | |
| 2018/0277989 | A1 * | 9/2018 | Hashiguchi | H01R 13/502 |

* cited by examiner

FIG.23
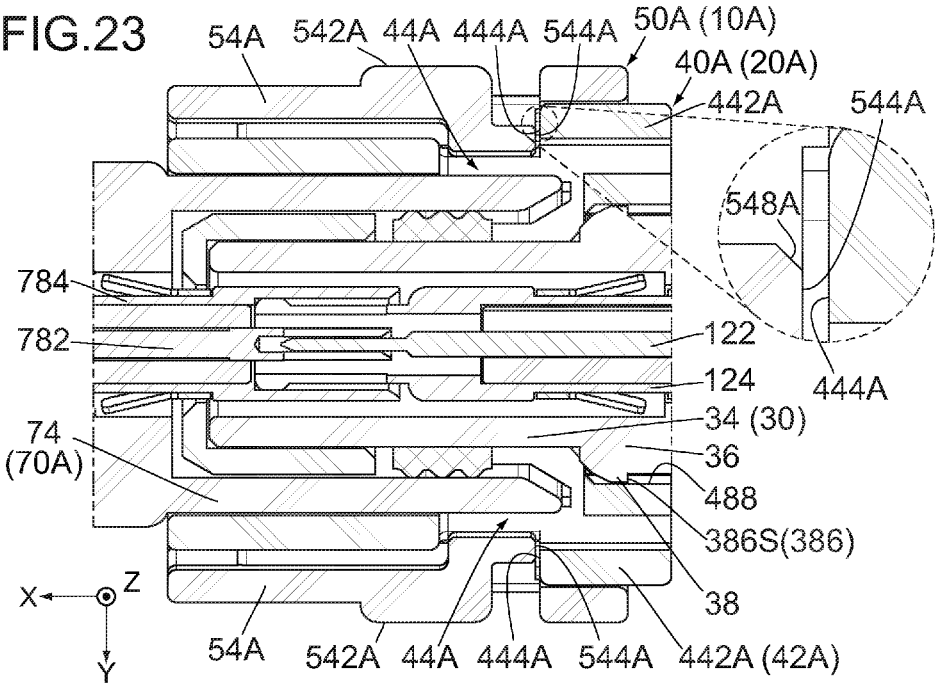
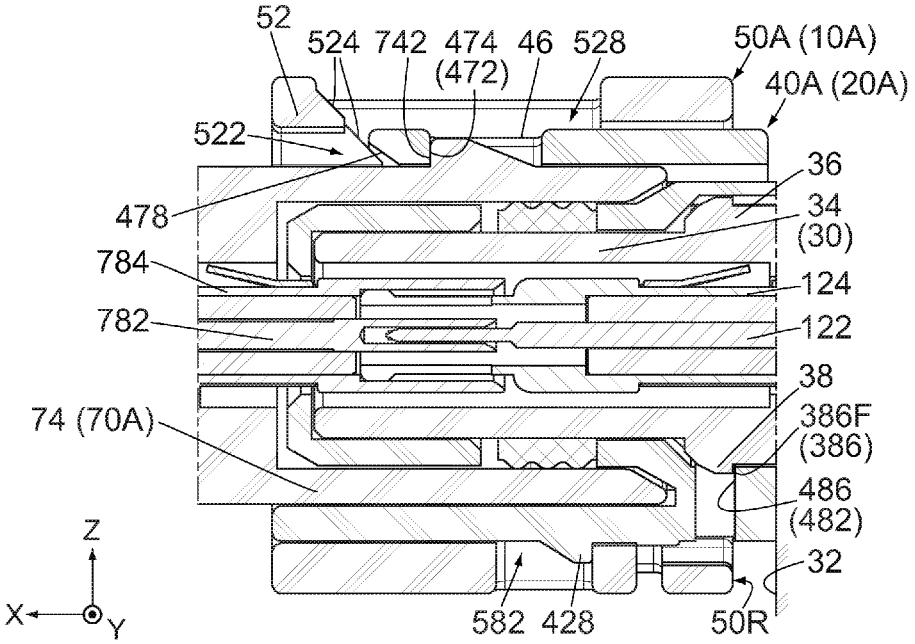
FIG.24

CONNECTOR

CROSS REFERENCE TO RELATED APPLICATIONS

This application is a Divisional application of U.S. application Ser. No. 15/871,309, filed Jan. 15, 2018, which is based on and claims priority under 35 U.S.C. § 119 to Japanese Patent Application No. JP 2017-057620, filed Mar. 23, 2017, the content of which is incorporated herein in its entirety by reference.

BACKGROUND OF THE INVENTION

This invention relates to a connector having a structure which maintains a mated state of the connector with a mating connector.

For example, this type of connector is disclosed in JP 2009-32587A (Patent Document 1), the content of which is incorporated herein by reference.

Referring to FIG. 29, Patent Document 1 discloses a connector 92 according to a first embodiment which is mateable with a mating connector 95 along a front-rear direction (X-direction). The connector 92 comprises an inner case (housing) 920, an outer case (slider) 930 and a lock ring (regulation member) 940. Referring to FIG. 30, the housing 920 has an engagement arm (lock portion) 922, and the slider 930 has an engagement-release portion (release portion) 932. The mating connector 95 has a lock portion (mating lock portion) 952. Under a mated state where the connector 92 is mated with the mating connector 95, the lock portion 922 locks the mating lock portion 952. Under the mated state, the regulation member 940 is in abutment with a rear end of the slider 930 to regulate a rearward movement, or a movement in the negative X-direction, of the slider 930.

Referring to FIG. 31, first in a removal operation of the connector 92 from the mating connector 95, the regulation member 940 is rotated by a predetermined angle about an axis in parallel to the front-rear direction. This rotation operation enables the slider 930 to be moved rearward without regulation. Then, the slider 930 is moved rearward, so that the release portion 932 moves the lock portion 922. As a result, the mating lock portion 952 is released, and the connector 92 can be removed from the mating connector 95. As described above, the connector 92 has a structure which is formed of the lock portion 955 and the regulation member 940 and which maintains the mated state with the mating connector 95.

In addition to the aforementioned connector, Patent Document 1 discloses various connectors comprising regulation members different from one another. Each of the connectors disclosed in Patent Document 1 requires two operations, namely a first operation and a second operation, when the connector is removed from a mating connector. In the first operation, the regulation member is rotated or pulled up, for example, so that the slider is made movable. Then, the second operation moves the slider. These two operations are difficult to be performed continuously and smoothly. In other words, the removal operation of the connector from the mating connector is inconvenient.

SUMMARY OF THE INVENTION

It is therefore an object of the present invention to provide a connector which has a structure for maintaining a mated state with a mating connector and which can improve operability of removal operation of the connector from the mating connector.

An aspect of the present invention provides a connector mateable with a mating connector having a mating lock portion along a front-rear direction under a state where the mating connector is located forward of the connector in the front-rear direction. The connector comprises a contact, a housing, a slider, a regulating portion and an operation portion. The contact is held by the housing. The housing has a lock portion. The lock portion is supported to be movable between a lock position and a release position. Under a mated state where the connector is mated with the mating connector, the lock portion is located at the lock position and locks the mating lock portion of the mating connector. The slider is attached to the housing to be movable in the front-rear direction. The slider has a release portion and a regulated portion. When the slider is moved in a release direction in parallel to the front-rear direction under the mated state, the release portion moves the lock portion from the lock position to the release position and releases the mating lock portion. Under the mated state, the regulating portion faces the regulated portion in the release direction and regulates a movement of the slider along the release direction. When the operation portion is operated to be pressed inward of the connector in an operation direction intersecting with the front-rear direction, at least one of the regulating portion and the regulated portion is moved, and the regulating portion does not regulate the movement of the slider.

The operation portion of the connector according to an aspect of the present invention is operable to be pressed inward of the connector in the operation direction intersecting with the front-rear direction (mating direction). When the operation portion is operated to be pressed, the regulating portion does not regulate the movement of the slider, so that the mating lock portion can be released by moving the slider in the release direction. Since the pressing direction in the pressing operation of the operation portion is directed inward of the connector, the slider can be held at the same time of the pressing operation. Therefore, the mating lock portion can be released by a continuous, smooth operation in which the slider is held because of the pressing operation of the operation portion, and the thus-held slider is moved in the release direction. As described above, the connector according to an aspect of the present invention can improve operability of removal operation of the connector from the mating connector.

An appreciation of the objectives of the present invention and a more complete understanding of its structure may be had by studying the following description of the preferred embodiment and by referring to the accompanying drawings.

BRIEF DESCRIPTION OF THE DRAWINGS:

FIG. 23 is a cross-sectional view showing a part of the connector (part enclosed by dashed line C) of FIG. 21, taken along line XXIII-XXIII, wherein a regulating portion, a regulated portion and therearound (parts enclosed by dashed line) are enlarged to be illustrated.

FIG. 24 is a cross-sectional view showing a part of the connector (part enclosed by dashed line D) of FIG. 22, taken along line XXIV-XXIV.

Figure 1:
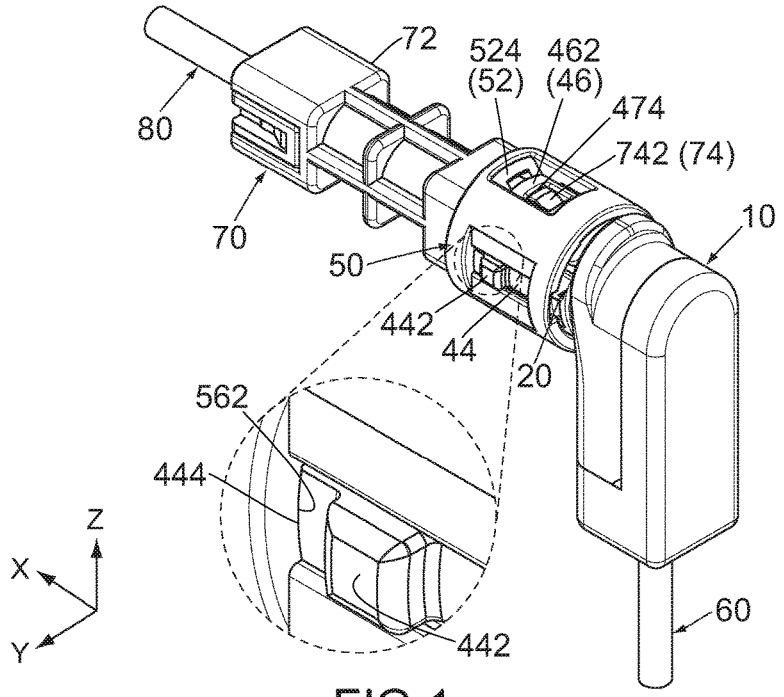
FIG. 1 is a perspective view showing a connector according to an embodiment of the present invention, wherein the connector is in a mated state where the connector is mated with a mating connector, and a part of the connector (part enclosed by dashed line) is enlarged to be illustrated.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention is mateable with a mating connector 70 along a front-rear direction (a mating direction: X-direction) under a state where the mating connector 70 is located forward of the connector 10 in the X-direction, or located toward the positive X-side of the connector 10. Moreover, the connector 10 is removable from the mating connector 70 along the X-direction.

In the present embodiment, the connector 10 is connected to a cable 60, and the mating connector 70 is connected to a mating cable 80. In other words, each of the connector 10 and the mating connector 70 is a cable connector. In particular, each of the connector 10 and the mating connector 70 of the present embodiment is a coaxial connector. However, the present invention is not limited thereto but is applicable to various types of connectors.

Hereafter, explanation will be made about a structure of the mating connector 70.

Figure 2:
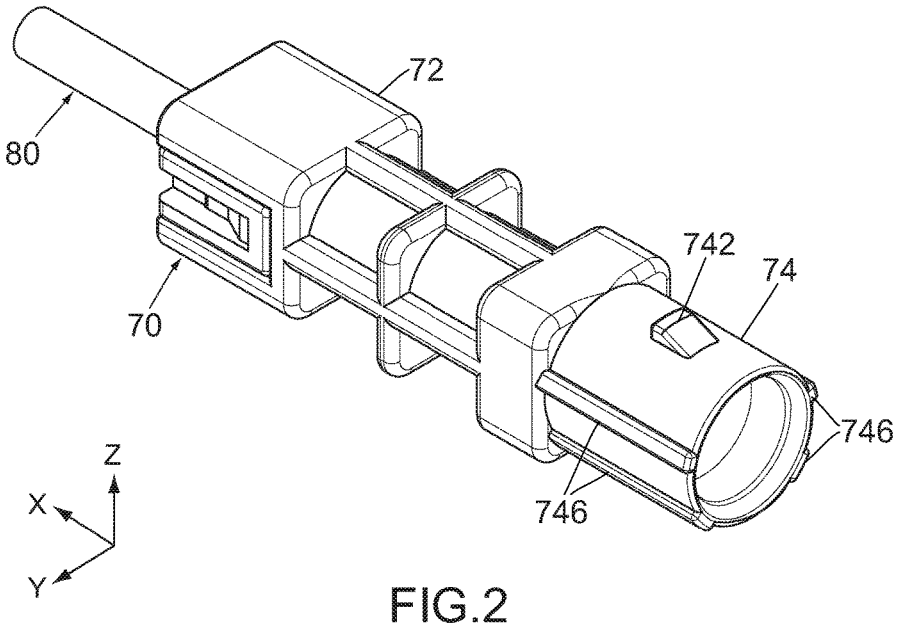
FIG. 2 is a perspective view showing the mating connector of FIG. 1.
Figure 11:
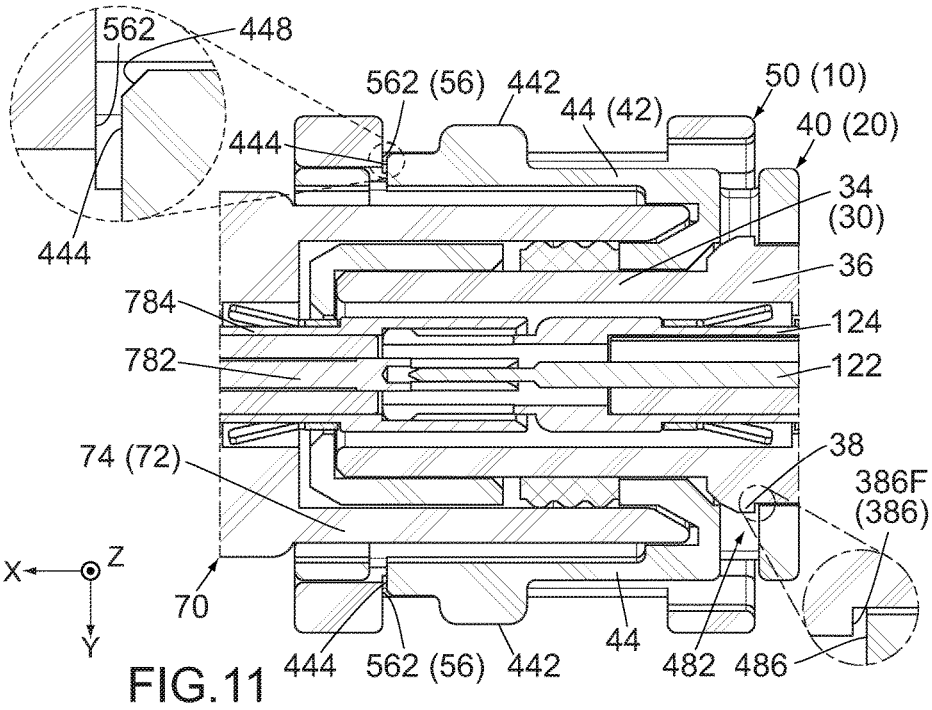
FIG. 11 is a cross-sectional view showing a part of the connector (part enclosed by dashed line A) of FIG. 7, taken along line XI-XI, wherein a regulating portion, a regulated portion and therearound (parts enclosed by dashed line) are enlarged to be illustrated, and a facing portion, an opposite facing portion and therearound (parts enclosed by chain dotted line) are enlarged to be illustrated.

Referring to FIGS. 2 and 11, the mating connector 70 comprises a mating housing 72 made of insulator such as resin and two mating contacts 782 and 784 each made of conductor such as metal. The mating contacts 782 and 784 are held by the mating housing 72 and connected to the mating cable 80.

As shown in FIG. 2, the mating housing 72 has a mating fit portion 74, a mating lock portion 742 and four guided portions 746. Each of the mating lock portion 742 and the guided portions 746 is provided on the mating fit portion 74. In the present embodiment, the mating fit portion 74 has a cylindrical shape which extends in the X-direction, and each of the mating lock portion 742 and the guided portions 746 projects from an outer circumferential surface of the mating fit portion 74 in a radial direction of the cylinder. However, the present invention is not limited thereto, but the mating fit portion 74 may have a shape different from the cylindrical shape. For example, the mating fit portion 74 may have a rectangular tubular shape which extends in the X-direction.

The mating lock portion 742 projects upward in an upper-lower direction (Z-direction) perpendicular to the X-direction, or projects in the positive Z-direction, from the outer circumferential surface of the mating fit portion 74. The mating lock portion 742 has a front surface, or the positive X-side surface, and a rear surface, or the negative X-side surface. The front surface of the mating lock portion 742 is a vertical surface perpendicular to the X-direction, and the rear surface of the mating lock portion 742 is a sloping surface oblique to the X-direction. Each of the guided portions 746 extends along the X-direction.

As can be seen from FIGS. 1 and 2, under a mated state where the connector 10 is mated with the mating connector 70, the mating fit portion 74 is inserted inside the connector 10 together with the mating lock portion 742 and the guided portions 746.

Hereafter, explanation will be made about a structure of the connector 10.

Figure 3:
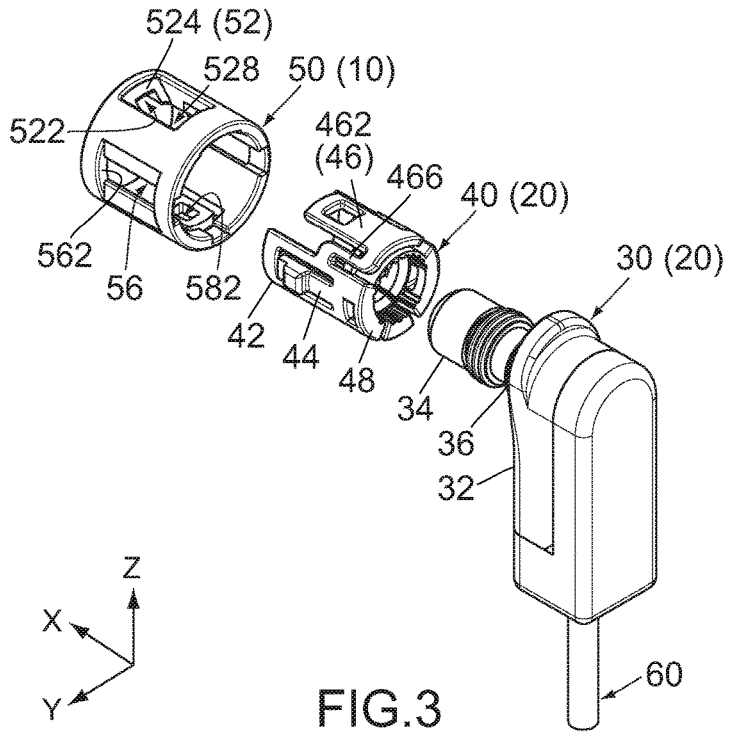
FIG. 3 is an exploded, perspective view showing the connector of FIG. 1.
Figure 4:
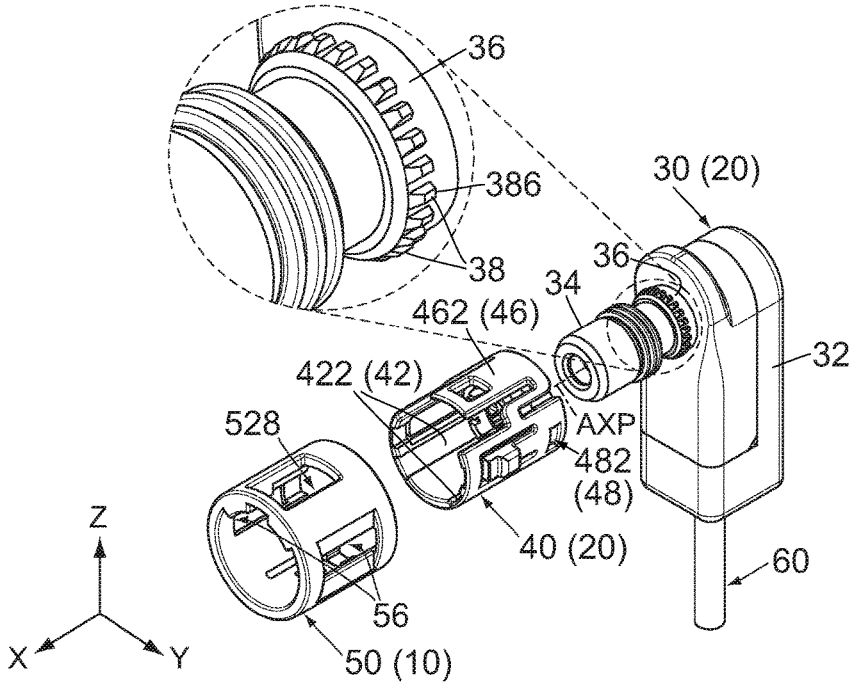
FIG. 4 is another exploded, perspective view showing the connector of FIG. 1, wherein a part of a main member of the connector (part enclosed by dashed line) is enlarged to be illustrated, and an imaginary central axis of an attachment portion of the main member is illustrated by chain dotted line.

Referring to FIGS. 3, 4 and 11, the connector 10 comprises two contacts 122 and 124 each made of conductor such as metal, a housing 20 and a slider 50 made of insulator such as resin. As described later, the housing 20 of the present embodiment is formed of a main member 30 made of insulator such as resin and a sub member 40 made of insulator such as resin which are combined with each other. In other words, the housing 20 comprises the main member 30 and the sub member 40. However, the present invention is not limited thereto. For example, the housing 20 may be a single member or formed of three or more members which are combined with one another.

Referring to FIG. 11, the contacts 122 and 124 are held by the housing 20 and connected to the cable 60 (see FIG. 4). In detail, the main member 30 of the housing 20 holds the contacts 122 and 124 and the cable 60. The contacts 122 and 124 are connected to the cable 60 inside the main member 30.

As shown in FIGS. 3 and 4, the main member 30 of the housing 20 has a base portion 32, a fit portion 34 and an attachment portion 36. The base portion 32 extends long in an extending direction along which the cable 60 extends. In other words, a longitudinal direction of the base portion 32 is equal to the extending direction of the cable 60. The longitudinal direction of the base portion 32 in the present embodiment is the Z-direction. The attachment portion 36 is located at one of opposite ends of the base portion 32 in the longitudinal direction and projects forward from the base portion 32. The fit portion 34 projects forward from a front end, or the positive X-side end, of the attachment portion 36.

The sub member 40 of the housing 20 has a shape corresponding to the fit portion 34 of the main member 30. More specifically, each of the fit portion 34 and the sub member 40 of the present embodiment has a cylindrical shape extending in the X-direction as a whole. In a perpendicular plane (YZ-plane) perpendicular to the X-direction, the sub member 40 is larger than the fit portion 34. As can be seen from FIGS. 1, 3 and 4, the sub member 40 is attached to the main member 30 so as to surround the fit portion 34 and the attachment portion 36 in the YZ-plane. Thus, the sub member 40 is attached to a front side, or the positive X-side, of the main member 30.

Figure 5:
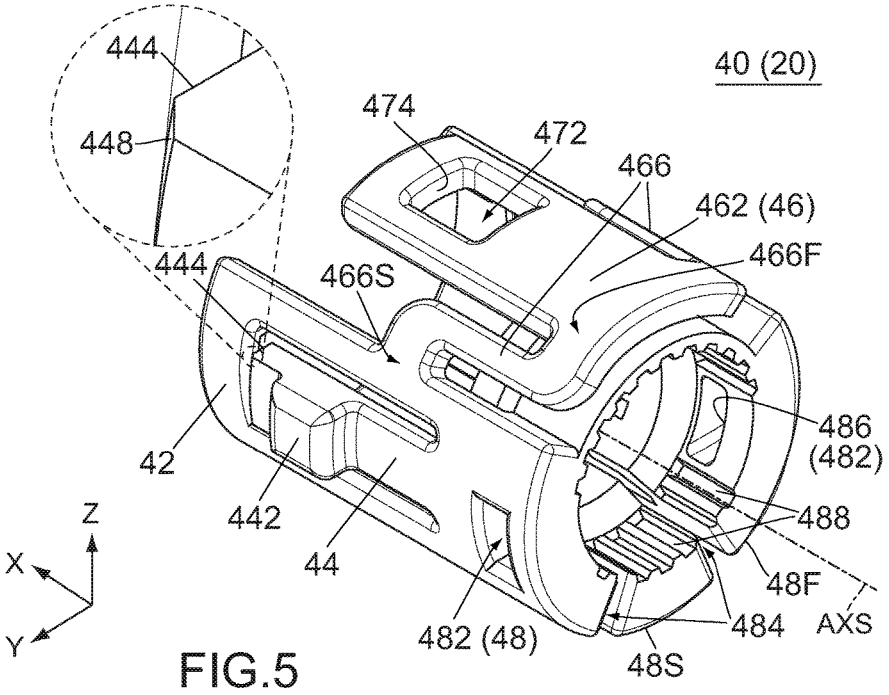
FIG. 5 is a perspective view showing a sub member of the connector of FIG. 3, wherein a part of the sub member (part enclosed by dashed line) is enlarged to be illustrated, and an imaginary central axis of an attached portion is illustrated by chain dotted line.

As shown in FIGS. 3 to 5, the sub member 40 of the housing 20 has a peripheral wall 42, a lock support portion 46 and an attached portion 48. The attached portion 48 has a cylindrical shape as a whole and is located in the vicinity of a rear end, or the negative X-side end, of the sub member 40. The peripheral wall 42 has a half cylindrical shape as a whole and extends forward from the attached portion 48. The lock support portion 46 has a plate shape, which is slightly bent to form an arc, as a whole. The lock support portion 46 is supported by the peripheral wall 42 and is located above the peripheral wall 42.

Referring to FIGS. 3 and 4, the slider 50 has a shape corresponding to the sub member 40 of the housing 20. More specifically, the slider 50 of the present embodiment has a cylindrical shape extending in the X-direction as a whole. In the YZ-plane, the slider 50 is larger than the sub member 40. The slider 50 is attached to the sub member 40 from the front thereof so as to surround the sub member 40 in the YZ-plane.

Figure 6:
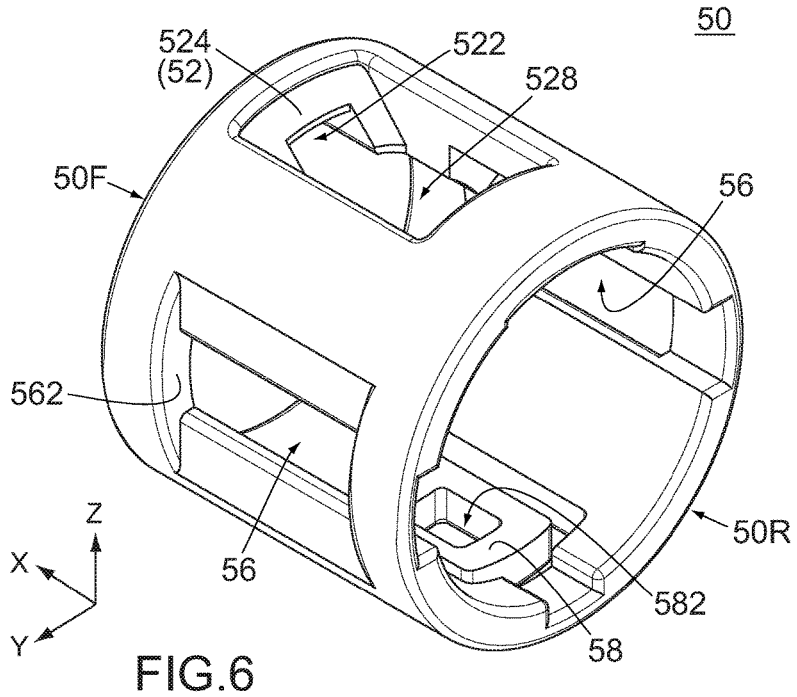
FIG. 6 is a perspective view showing a slider of the connector of FIG. 3.
Figure 10:
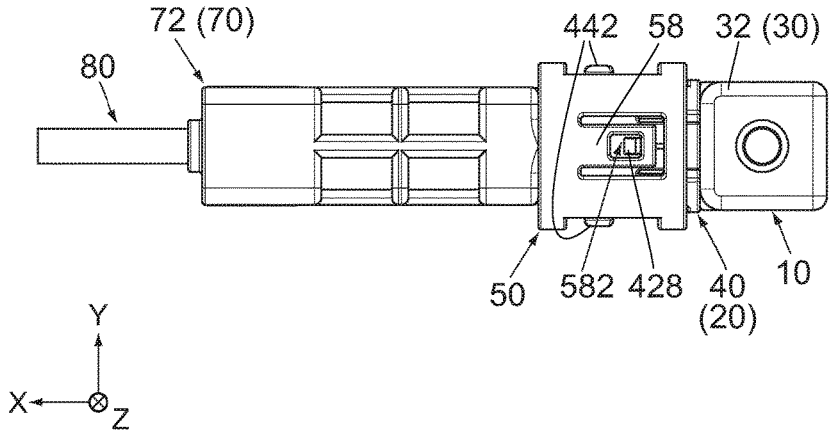
FIG. 10 is a bottom view showing the connector of FIG. 1.

As shown in FIGS. 6 and 10, the slider 50 is formed with a spring piece 58. The spring piece 58 is a plate-like portion and resiliently deformable. The spring piece 58 is located at a lower end, or the negative Z-side end, of the slider 50 and extends approximately in the XY-plane. The spring piece 58 is formed with an insertion hole 582. The insertion hole 582 passes through the spring piece 58 in the Z-direction.

Figure 8:
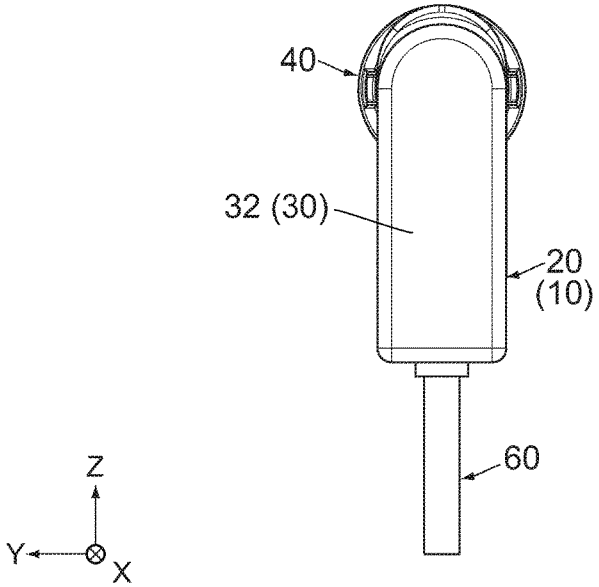
FIG. 8 is a rear view showing the connector of FIG. 1.
Figure 12:
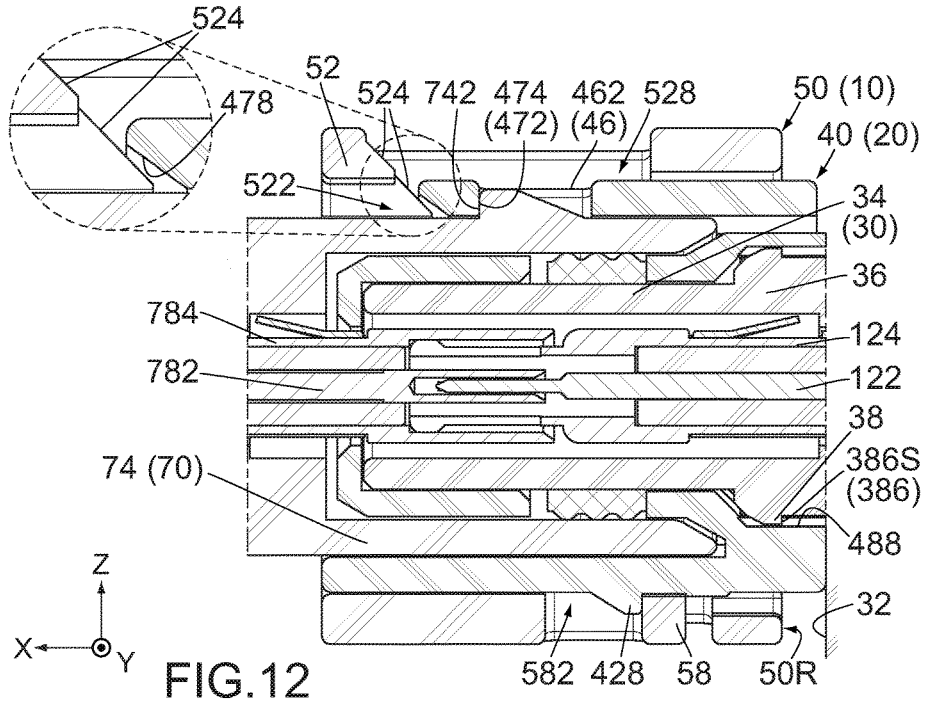
FIG. 12 is a cross-sectional view showing a part of the connector (part enclosed by dashed line B) of FIG. 9, taken along line XII-XII, wherein a pressing ramp, a pressed ramp and therearound (parts enclosed by dashed line) are enlarged to be illustrated.

As shown in FIGS. 10 and 12, the sub member 40 of the housing 20 is formed with an insertion projection 428. The insertion projection 428 is inserted in the insertion hole 582 so that the slider 50 is prevented from coming off the sub member 40. In detail, when the slider 50 is moved forward, a rear inner surface perpendicular to the X-direction of the insertion hole 582 is brought into abutment with a rear surface perpendicular to the X-direction of the insertion projection 428, and the slider 50 is stopped. In addition, referring to FIGS. 10 and 12 together with FIG. 8, the slider 50 cannot be moved rearward, or in the negative X-direction, beyond the base portion 32 of the main member 30 of the housing 20.

Referring to FIGS. 10 and 12, a size of the insertion hole 582 in the X-direction is larger than another size of the insertion projection 428 in the X-direction. The slider 50 is movable between a front position (position shown in FIGS. 1 and 7 to 13) and a rear position (position shown in FIGS. 14 to 16) along the X-direction in accordance with a movement of the insertion projection 428 in the insertion hole 582, wherein the front position is defined by the rear inner surface of the insertion hole 582, and the rear position is defined by a front surface of the base portion 32 of the main member 30. In other words, the slider 50 is attached to the housing 20 to be movable in the X-direction.

Referring to FIG. 4, the peripheral wall 42 of the sub member 40 of the housing 20 is provided with two guide channels 422. Each of the guide channels 422 is formed in an inner circumferential surface of the peripheral wall 42. Each of the guide channels 422 is recessed in a radial direction of the peripheral wall 42 and extends along the X-direction. Referring to FIGS. 2 and 4, the two guide channels 422 correspond to lower (negative Z-side) two of the guided portions 746 of the mating connector 70, respectively, and guide these two guided portions 746, respectively, when the mating fit portion 74 of the mating connector 70 is inserted into the connector 10. However, the present invention is not limited thereto, but the guide channels 422 and the guided portions 746 may be provided as necessary.

Referring to FIG. 11, under the mated state, the mating fit portion 74 of the mating connector 70 is fit on the fit portion 34 of the connector 10. In detail, under the mated state, the mating fit portion 74 is accommodated inside the sub member 40 while accommodating the fit portion 34 therewithin. In other words, under the mated state, the mating fit portion 74 is inserted between the sub member 40 and the fit portion 34. As can be seen from this structure, each of the fit portion 34 and the sub member 40 may have a shape corresponding to the mating fit portion 74. For example, in a case where the mating fit portion 74 has a rectangular tubular shape, each of the fit portion 34 and the sub member 40 may have a rectangular tubular shape.

Under the mated state, the contacts 122 and 124 are connected to the mating contacts 782 and 784 of the mating connector 70, respectively, so that the cable 60 (see FIG. 1) is electrically connected with the mating cable 80 (see FIG. 1).

Hereafter, explanation will be made about a structure for maintaining the mated state of the connector 10 with the mating connector 70. First, explanation will be made about a lock mechanism that locks the mated state.

Referring to FIG. 5, the lock support portion 46 of the sub member 40 of the housing 20 has a plate-like portion 462 and two spring portions 466. The plate-like portion 462 has a rectangular plate shape when seen along the Z-direction. Each of the spring portions 466 has a bent portion. In detail, each of the spring portions 466 has a straight portion which extends straight along the X-direction, an intersecting portion which intersects with the straight portion and extends from a front end of the straight portion to the peripheral wall 42, and another intersecting portion which intersects with the straight portion and extends from a rear end of the straight portion to a rear end of the plate-like portion 462. Each of the thus-formed spring portions 466 has a first end 466F connected to the plate-like portion 462 and a second end 466S connected to the peripheral wall 42, or a part other than the plate-like portion 462 of the housing 20. The first end 466F and the second end 466S of each of the spring portions 466 are located at positions different from each other in the X-direction.

The lock support portion 46 has the aforementioned structure and is resiliently deformable. In particular, the lock support portion 46 of the present embodiment is easily resiliently deformed because the lock support portion 46 is connected to the peripheral wall 42 only at the second ends 466S of the two spring portions 466 each of which has high resilience. However, the present invention is not limited thereto, but the lock support portion 46 may be shaped in various shapes.

Referring to FIGS. 5 and 12, the lock support portion 46 has a receiving portion 472. The receiving portion 472 is a hole formed in the lock support portion 46. The receiving portion 472 passes through the lock support portion 46 in the Z-direction and has a rectangular shape when seen along the Z-direction. The receiving portion 472 has a front inner surface provided with a lock portion 474. In other words, the housing 20 has the lock portion 474. The lock portion 474 is a vertical surface perpendicular to the X-direction. The lock portion 474 is movable mainly in the Z-direction in accordance with the resilient deformation of the lock support portion 46.

Referring to FIG. 12, under the mated state, the mating lock portion 742 of the mating connector 70 is received in the receiving portion 472, and the lock portion 474 is located forward of the mating lock portion 742. When the connector 10 is pulled rearward under this state, a front surface perpendicular to the X-direction of the mating lock portion 742 is brought into abutment with the lock portion 474 perpendicular to the X-direction. Therefore, the connector 10 cannot be removed from the mating connector 70. In other words, the lock portion 474 locks the mating lock portion 742. The position of the thus-located lock portion 474 is referred to as a lock position. Thus, under the mated state, the lock portion 474 is located at the lock position and locks the mating lock portion 742 of the mating connector 70.

As previously described, in the present embodiment, the receiving portion 472 is the hole formed in the lock support portion 46, and the front inner surface of the receiving portion 472 works as the lock portion 474. However, the present invention is not limited thereto. For example, the receiving portion 472 may be a recess formed in the lock support portion 46, provided that the receiving portion 472, at least in part, receives and locks the mating lock portion 742 under the mated state. More specifically, the receiving portion 472 may be recessed upward in a perpendicular direction (Z-direction) perpendicular to the X-direction.

Figure 9:
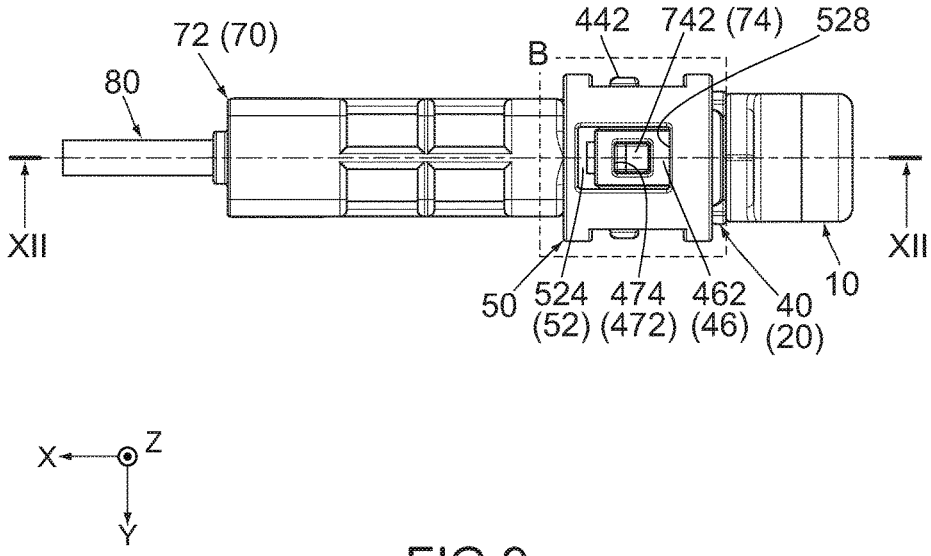
FIG. 9 is a top view showing the connector of FIG. 1.

As shown in FIG. 6, the slider 50 is formed with an accommodation hole 528. The accommodation hole 528 passes through an upper part, or the positive Z-side part, of the slider 50 in the Z-direction. Referring to FIGS. 9 and 12, a front part of the plate-like portion 462 of the lock support portion 46 including the receiving portion 472 is accommodated in the accommodation hole 528. Therefore, the lock portion 474 is located inside the accommodation hole 528 and is movable inside the accommodation hole 528.

As shown in FIG. 6, the slider 50 has a release portion 52. The release portion 52 is located forward of the accommodation hole 528. The release portion 52 has a pressed ramp 524. In other words, the slider 50 is formed with the pressed ramp 524. The pressed ramp 524 is a rear surface of the release portion 52. Moreover, the pressed ramp 524 is a sloping surface which slopes rearward and downward, or in the negative Z-direction. The pressed ramp 524 has a U-like shape when seen along the perpendicular direction, or along the Z-direction.

Referring to FIG. 12, the lock support portion 46 has a front end formed with a pressing ramp 478. The pressing ramp 478 slopes so as to correspond to the pressed ramp 524. In detail, the pressing ramp 478 is a front end surface of the plate-like portion 462 of the lock support portion 46 and is a sloping surface which slopes rearward and downward. The pressing ramp 478 continuously extends between opposite sides of the plate-like portion 462 in the Y-direction. Referring to FIG. 12 together with FIG. 9, when the slider 50 is located at the front position, or the position shown in FIGS. 9 and 12, opposite sides of the pressing ramp 478 in the Y-direction are in contact with opposite sides of the pressed ramp 524 in the Y-direction, respectively, or are located right above and slightly apart from the opposite sides of the pressed ramp 524, respectively.

Referring to FIGS. 6 and 12, the slider 50 is formed with a passage channel 522. The passage channel 522 passes through the release portion 52 in the X-direction and opens forward and rearward of the release portion 52. In detail, the passage channel 522 has a front part and a rear part (negative X-side part), wherein the front part is a hole which passes through the release portion 52 in the X-direction, and the rear part is a recess which is formed in the release portion 52 and is recessed downward from the pressed ramp 524 while extending in the X-direction. The passage channel 522 has a rear end which is located at a position same as that of a rear end of the pressed ramp 524 in the X-direction and is located at a front end of the accommodation hole 528 in the X-direction. The pressed ramp 524 slopes forward and upward from a starting point which is the rear end of the passage channel 522.

Referring to FIG. 12, a size of the passage channel 522 in the YZ-plane is larger than another size of the mating lock portion 742 of the mating connector 70 in the YZ-plane. The thus-formed passage channel 522 allows the mating lock portion 742 to be moved therethrough along the X-direction. More specifically, in a mating process of the connector 10 with the mating connector 70, the mating lock portion 742 passes through the passage channel 522. Subsequently, a sloping rear surface of the mating lock portion 742 is brought into contact with the pressing ramp 478 of the lock support portion 46. The pressing ramp 478 is pressed by the rear surface of the mating lock portion 742 and is moved upward, and subsequently the mating lock portion 742 is located inside the receiving portion 472 which is accommodated in the accommodation hole 528. At that time, the mating lock portion 742 is locked by the lock portion 474 located at the lock position.

Figure 16:
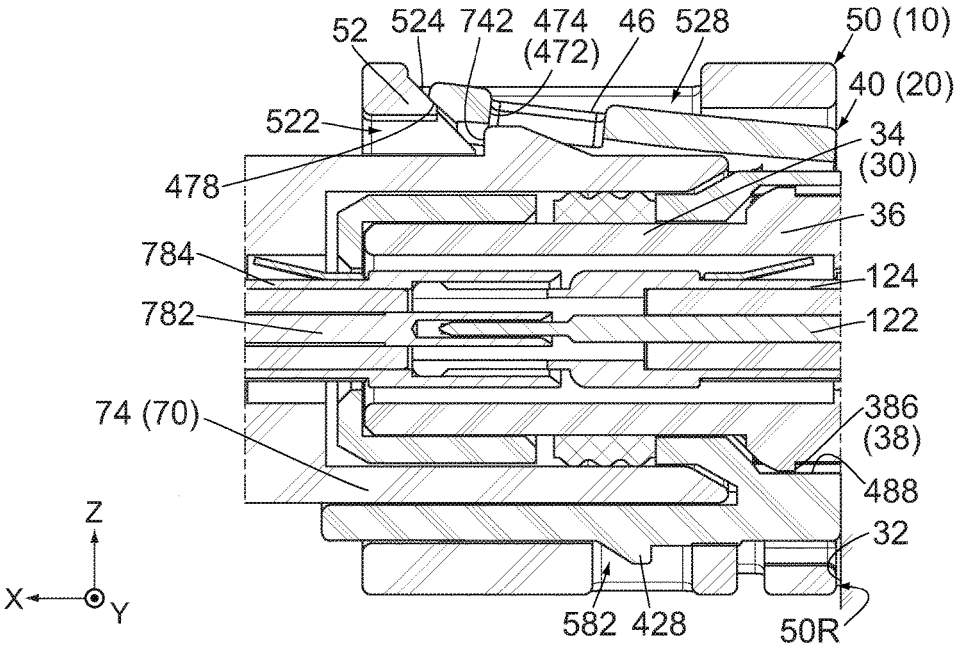
FIG. 16 is a cross-sectional view showing the connector of FIG. 12, wherein the slider is moved rearward.

Referring to FIG. 12, when the lock portion 474 is located at the lock position, the pressing ramp 478 and the pressed ramp 524 partially face each other in the X-direction. When the slider 50 is moved rearward, the pressing ramp 478 is brought into surface contact with the pressed ramp 524. Referring to FIGS. 12 and 16, when the slider 50 is kept to be moved rearward, the pressing ramp 478 slides on the pressed ramp 524. Meanwhile, the lock support portion 46 is resiliently deformed, and the lock portion 474 is moved upward. Referring to FIG. 16, when the lock portion 474 is moved upward by a predetermined distance, the mating lock portion 742 can be moved forward without abutment thereof with the lock portion 474. In other words, the mating lock portion 742 is released. The position of the thus-located lock portion 474 is referred to as a release position.

As can be seen from the explanation described above, when the slider 50 is moved rearward, or moved in a release direction (negative X-direction) in parallel to the X-direction, under the mated state, the release portion 52 moves the lock portion 474 from the lock position to the release position and releases the mating lock portion 742. When the connector 10 is pulled rearward under this state, the connector 10 can be removed from the mating connector 70. As can be seen from FIGS. 12 and 16, the lock support portion 46 supports the lock portion 474 so that the lock portion 474 is movable between the lock position and the release position. In other words, the lock portion 474 is supported to be movable between the lock position and the release position.

As described above, a movement operation of the slider 50 in the release direction (negative X-direction) unlocks the mated state. The release direction in the present embodiment is a rearward direction in the X-direction. However, the present invention is not limited thereto. For example, the connector 10 can be formed so that a frontward movement of the slider 50 unlocks the mated state. In other words, the release direction may be a forward direction.

Referring to FIGS. 11 and 12, as described later, the rearward movement of the slider 50 under the mated state is regulated, so that the mated state is securely maintained. Thus, the connector 10 has, in addition to the lock mechanism that locks the mated state, a movement regulation mechanism that regulates the movement of the slider 50 along the release direction (negative X-direction) to securely maintain the mated state. Hereafter, explanation will be made about the movement regulation mechanism.

Referring to FIGS. 5 and 11, the peripheral wall 42 of the sub member 40 of the housing 20 is provided with two operation support portions 44. The operation support portions 44 are located at opposite sides of the peripheral wall 42 in the Y-direction, respectively. Each of the operation support portions 44 is provided with an operation portion 442, a regulating portion 444 and a release ramp 448. In other words, the housing 20 has the two operation support portions 44 and two sets each consisting of the operation portion 442, the regulating portion 444 and the release ramp 448.

Each of the operation support portions 44 extends along the X-direction and is resiliently deformable. In detail, each of the operation support portions 44 of the present embodiment has a rear end connected to the peripheral wall 42 and is supported by the peripheral wall 42 in a cantilever manner. In each of the operation support portions 44 of the present embodiment, the rear end is a fixed end, and a front end is a free end. When each of the operation support portions 44 is resiliently deformed, the operation portion 442, the regulating portion 444 and the release ramp 448 are moved mainly in the Y-direction. In other words, each of the operation portions 442, the regulating portions 444 and the release ramps 448 is supported by the corresponding operation support portion 44 to be movable mainly in the Y-direction.

According to the present embodiment, the operation portion 442 is located nearer to the front end of the operation support portion 44 beyond the middle of the operation support portion 44 in the X-direction and projects outward in the Y-direction from the operation support portion 44. The regulating portion 444 is a front end surface of the operation support portion 44 and is a vertical surface perpendicular to the X-direction when the operation portion 442 is not resiliently deformed. The release ramp 448 is a plane which is oblique to both the X-direction and the Y-direction and which is in parallel to the Z-direction. The release ramp 448 is a chamfered edge which is an outside edge of the front end surface of the operation support portion 44 in the Y-direction. In other words, the release ramp 448 is located outward of the regulating portion 444 in the Y-direction.

Referring to FIGS. 6 and 11, the slider 50 has two passage holes 56 and two regulated portions 562. The two passage holes 56 are formed in opposite sides of the slider 50 in the Y-direction, respectively. Each of the two passage holes 56 passes through the slider 50 in the Y-direction. The two regulated portions 562 are provided so as to correspond to the two passage holes 56, respectively. Each of the regulated portions 562 is a front inner surface of the corresponding passage hole 56 and a vertical surface perpendicular to the X-direction.

Figure 7:
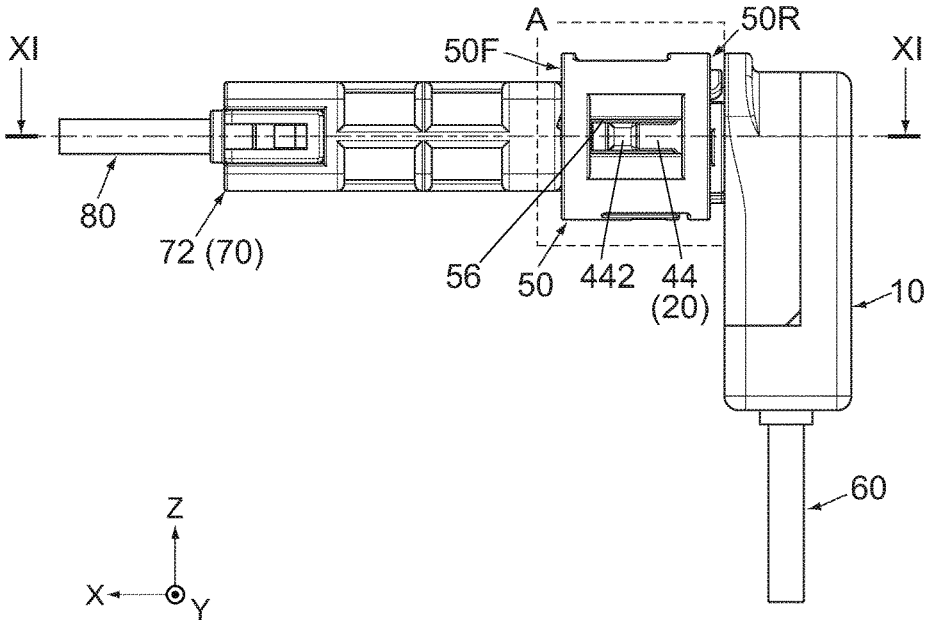
FIG. 7 is a side view showing the connector of FIG. 1.

Referring to FIGS. 7 and 11, the two passage holes 56 are provided so as to correspond to the two operation support portions 44 of the housing 20, respectively. The operation portion 442 of each of the operation support portions 44 is located inside the corresponding passage hole 56 and exposed outward of the slider 50. The thus-located operation portion 442 is operable from the outside of the connector 10.

Referring to FIG. 11, the regulated portions 562 of the slider 50 are arranged so as to correspond to the regulating portions 444 of the housing 20, respectively. More specifically, under the mated state, each of the regulating portions 444 is slightly apart from and is located rearward of the corresponding regulated portion 562 and faces the corresponding regulated portion 562 in the release direction (negative X-direction). The thus-arranged regulating portions 444 regulate a movement of the slider 50 along the release direction. In detail, when the slider 50 is moved in the release direction, the regulated portions 562 are brought into abutment with the regulating portions 444, respectively, and the slider 50 is stopped. The position of the thus-located regulating portion 444, or the position shown in FIG. 11, is referred to as a regulation position. Thus, the regulating portions 444 face the regulated portions 562 in the release direction, respectively, when the regulating portions 444 are located at the regulation position.

According to the present embodiment, the two regulated portions 562 are located at the opposite sides of the slider 50 in the Y-direction, respectively, and the two regulating portions 444 face the regulated portions 562, respectively. According to this arrangement, the regulating portions 444 more securely regulate the movement of the slider 50 in the release direction. However, the present invention is not limited thereto. For example, the slider 50 may have only one of the regulated portions 562. In this case, the housing 20 may have only one of the operation support portions 44 provided with the one regulating portion 444 and the one operation portion 442.

Figure 13:
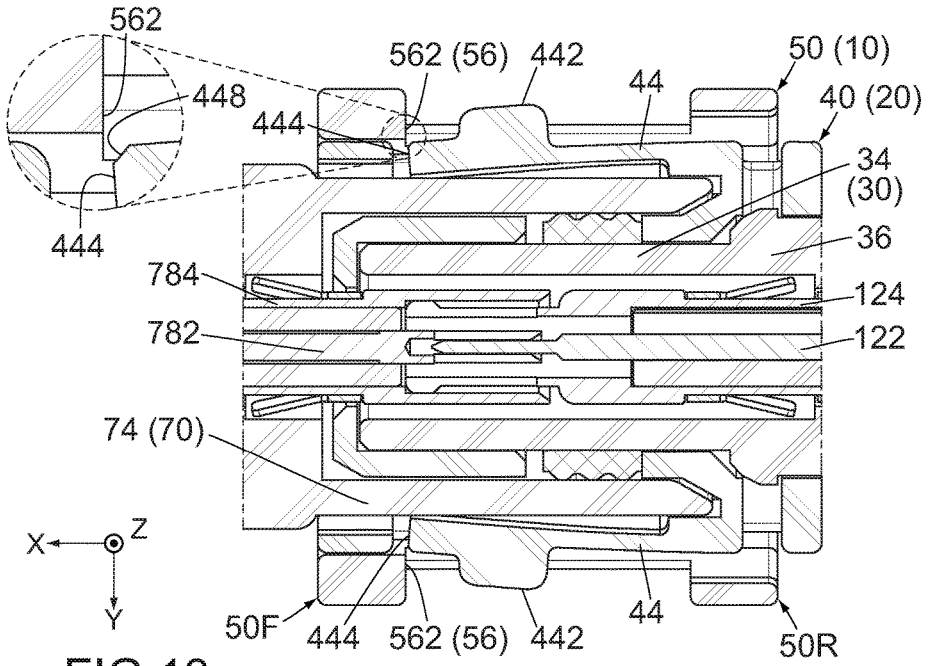
FIG. 13 is a cross-sectional view showing the connector of FIG. 11, wherein an operation portion is operated to be pressed, and the regulating portion, the regulated portion and therearound (parts enclosed by dashed line) are enlarged to be illustrated.

Referring to FIGS. 11 and 13, each of the operation portions 442 of the housing 20 is movable about a fulcrum, or the rear end (fixed end) of the operation support portion 44. In other words, the operation portion 442 is operable so as to be moved along an operation direction intersecting with the X-direction. The operation direction of the operation portion 442 in the present embodiment is a pivoting direction about the fixed end of the operation support portion 44 and is oblique to the X-direction. However, the present invention is not limited thereto. For example, the operation direction may be the Y-direction perpendicular to the X-direction.

When each of the operation portions 442 is operated to be pressed inward of the connector 10 in the operation direction, the regulating portion 444 is moved inward of the connector 10 and is moved to a non-regulation position, or the position shown in FIG. 13, along the operation direction.

Referring to FIG. 13, when each of the regulating portions 444 is located at the non-regulation position, each of the regulating portions 444 does not face the corresponding regulated portion 562 in the release direction (negative X-direction). Therefore, the slider 50 can be moved in the release direction without abutment of the regulated portions 562 with the corresponding regulating portions 444. In other words, when the operation portions 442 are operated to be pressed inward of the connector 10 in the operation direction, the regulating portions 444 do not regulate the movement of the slider 50. In the present embodiment, the operation support portions 44 support the regulating portions 444, respectively, so that each of the regulating portions 444 is movable between the regulation position and the non-regulation position in accordance with the movement of the corresponding operation portion 442.

Figure 14:
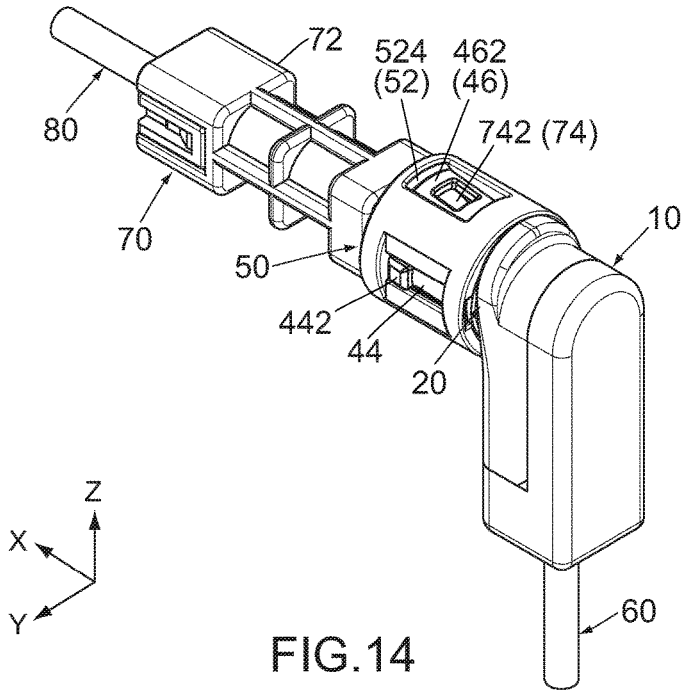
FIG. 14 is a perspective view showing the connector of FIG. 1, wherein the slider is moved rearward.
Figure 15:
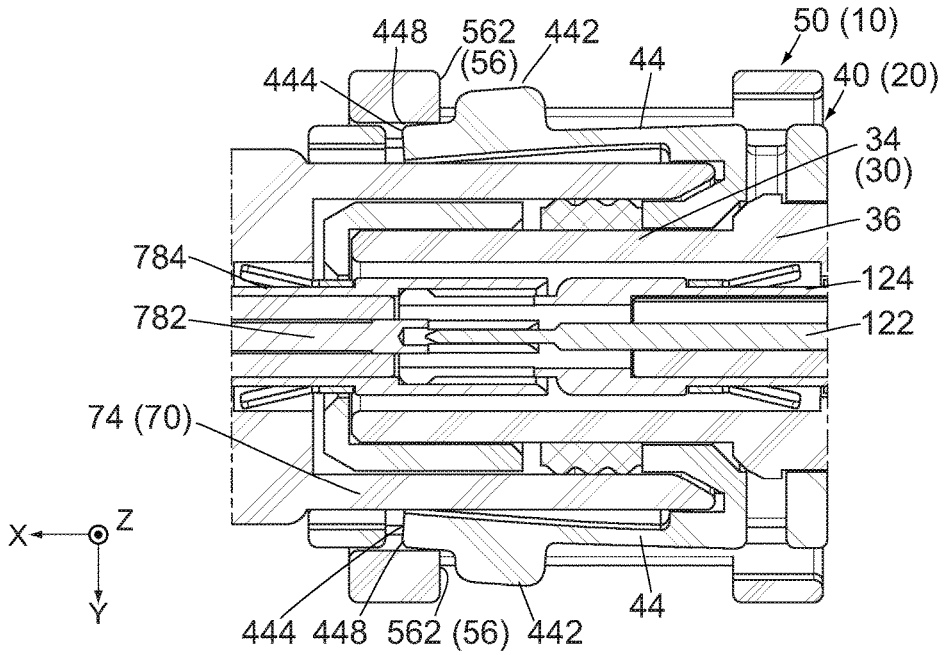
FIG. 15 is a cross-sectional view showing the connector of FIG. 11, wherein the slider is moved rearward.

Referring to FIGS. 14 to 16, when the slider 50 is moved in the release direction (negative X-direction) subsequent to the cancelation of the movement regulation of the slider 50 by the pressing operation of the operation portions 442, the mating lock portion 742 of the mating connector 70 can be released as previously described. Since the pressing direction in the pressing operation of the operation portions 442 is directed inward of the connector 10, the slider 50 can be held at the same time of the pressing operation. Therefore, the mating lock portion 742 can be released by a continuous, smooth operation in which the operation portions 442 are held between fingers, the slider 50 is also held during the pressing operation of the operation portions 442, and the thus-held slider 50 is moved in the release direction by sliding the fingers in the release direction. As described above, the connector 10 according to the present embodiment can improve operability of the removal operation of the connector 10 from the mating connector 70.

Referring to FIG. 7, according to the present embodiment, each of the operation portions 442 is located between a front end 50F and a rear end 50R of the slider 50 in the X-direction. In addition, referring to FIG. 13, the two operation portions 442 correspond to the two regulating portions 444, respectively, and are located at the opposite sides of the slider 50 in the Y-direction. Therefore, when the operation portions 442 are held between two fingers, the two fingers can hold the slider 50 therebetween at the same time of the pressing operation of the two operation portions 442. According to the present embodiment, the slider 50 can be easily operated. However, the present invention is not limited thereto. For example, each of the operation portions 442 may be located rearward of the rear end 50R of the slider 50 to some extent.

Referring to FIG. 16, when the slider 50 is moved in the release direction (negative X-direction) and releases the mating lock portion 742 of the mating connector 70, the lock support portion 46 of the housing 20 is resiliently deformed and presses the pressing ramp 478 against the pressed ramp 524 of the slider 50. The thus-pressed pressing ramp 478 applies a forward force to the pressed ramp 524. Referring to FIG. 16 together with FIG. 15, when the pressing operation of the operation portions 442 is stopped under this state after the removal of the connector 10 from the mating connector 70, this forward force applied from the pressing ramp 478 moves the slider 50 forward.

Referring to FIG. 16, as the slider 50 is moved forward, the lock support portion 46 is made closer to an initial state in which the lock support portion 46 is not resiliently deformed. Therefore, as the slider 50 is moved forward, the forward force applied to the pressed ramp 524 from the pressing ramp 478 becomes weaker. However, referring to FIG. 16 together with FIG. 13, when the slider 50 is moved forward by a predetermined distance, the slider 50 receives another forward force from the release ramps 448 of the operation support portions 44.

In detail, referring to FIGS. 13 and 15, as the slider 50 is moved forward, a predetermined edge of each of the regulated portions 562, which is located at an inside part of the regulated portion 562 in the Y-direction, slides on an outer surface of the operation support portion 44 in the Y-direction and approaches the release ramp 448. The release ramp 448, which is located outward of the regulating portion 444 in the operation direction, is brought into contact with the predetermined edge of the regulated portion 562 when the slider 50 is moved forward by the predetermined distance. At that time, the release ramp 448 applies a force caused by a restoring force of the operation support portion 44 to the predetermined edge of the regulated portion 562. As a result, the slider 50 receives additional forward force from the release ramp 448 and is further moved forward.

Referring to FIGS. 15 and 16, according to the present embodiment, when the pressing operation of the operation portions 442 is merely stopped, the slider 50, which has been moved in the release direction (negative X-direction), returns to its initial position, or the position shown in FIGS. 1 and 7 to 12, by the force applied from the pressing ramp 478 and the release ramps 448. In particular, since the slider 50 of the present embodiment receives the force from the two release ramps 448, the slider 50 more certainly returns to the initial position.

Hereafter, explanation will be made about a structure for combining the main member 30 and the sub member 40 of the housing 20 with each other.

Referring to FIG. 4, the attachment portion 36 of the main member 30 has a cylindrical shape about a central axis, or an imaginary shaft AXP in parallel to the X-direction. The attachment portion 36 of the main member 30 is formed with projections 38. The projections 38 are provided on an outer circumferential surface of the attachment portion 36 and arranged at regular intervals in a circumferential direction of the imaginary shaft AXP. In detail, any two of the projections 38 adjacent to each other in the circumferential direction of the imaginary shaft AXP are apart from each other by a central angle (predetermined angle) CA in the circumferential direction of the imaginary shaft AXP. This predetermined angle CA is equal to 360°/N (N is the number of the projections 38). Thus, the projections 38 are arranged to be apart from one another by the predetermined angle CA in the circumferential direction of the imaginary shaft AXP.

Each of the projections 38 projects outward in a radial direction of the imaginary shaft AXP from the outer circumferential surface of the attachment portion 36. Each of the projections 38 has a front surface and a rear surface. The front surface of the projection 38 is a sloping surface oblique to the X-direction. The rear surface the projection 38 is a vertical surface perpendicular to the X-direction and works as a facing portion 386 as described later. Thus, the main member 30 has the facing portions 386.

As shown in FIG. 5, the attached portion 48 of the sub member 40 has, as a whole, a cylindrical shape about a central axis, or an imaginary shaft AXS in parallel to the X-direction. The attached portion 48 of the sub member 40 is formed with two recessed portions 482 and a plurality of receiving grooves 488. The recessed portions 482 and the receiving grooves 488 are provided in an inner circumferential surface of the attached portion 48 and arranged in a circumferential direction of the imaginary shaft AXS.

The attached portion 48 is separated into two portions, namely a first portion 48F and a second portion 48S, by two separation grooves 484. The first portion 48F is rather larger than the second portion 48S. In detail, the first portion 48F has a cut-away cylindrical shape and is formed with the two recessed portions 482 and many number of the receiving grooves 488. By contrast, the second portion 48S is a small piece formed with three of the receiving grooves 488.

In the present embodiment, each of the recessed portions 482 is a hole which passes through the attached portion 48 in a radial direction of the imaginary shaft AXS. Each of the recessed portions 482 has a rear inner surface. The rear inner surface of the recessed portion 482 is a vertical surface perpendicular to the X-direction and works as an opposite facing portion 486 as described later. Thus, the sub member 40 has the two opposite facing portions 486. As described above, each of the recessed portions 482 of the present embodiment is the hole. However, the present invention is not limited thereto. For example, each of the recessed portions 482 may be a recess formed in the inner circumferential surface of the attached portion 48, provided that each of the recessed portions 482 has a part that works as the opposite facing portion 486.

Each of the receiving grooves 488 is a recess formed in the inner circumferential surface of the attached portion 48. Each of the receiving grooves 488 extends in the X-direction and opens rearward at a rear end of the attached portion 48. Any two of the receiving grooves 488 that are adjacent to each other with none of the recessed portions 482 and none of the separation grooves 484 therebetween in the circumferential direction of the imaginary shaft AXS are apart from each other by the central angle (predetermined angle) CA in the circumferential direction of the imaginary shaft AXS. A size of the receiving groove 488 in the circumferential direction of the imaginary shaft AXS is slightly larger than another size of the projection 38 (see FIG. 4) in the circumferential direction of the imaginary shaft AXP (see FIG. 4).

Referring to FIGS. 4 and 5, when the main member 30 is arranged rearward of the sub member 40 under a state where the imaginary shaft AXP is equal to the imaginary shaft AXS and a predetermined one of the projections 38 is located right behind one of the receiving grooves 488, each of the projections 38 is located right behind the recessed portion 482 or right behind a space such as the receiving groove 488 and the separation groove 484. The facing portion 386 of the projection 38 that is located right behind the recessed portion 482 under this state is referred to as a first facing portion 386F, and the facing portion 386 other than the first facing portion 386F is referred to as a second facing portion 386S. As described above, the facing portions 386 are grouped into the first facing portions 386F and the second facing portions 386S depending on a positional relation between the facing portions 386 and the recessed portions 482. In other words, the facing portions 386 include one or more of the first facing portions 386F and one or more of the second facing portions 386S.

When the main member 30 is moved forward under the aforementioned arrangement in which the main member 30 is arranged rearward of the sub member 40, the attachment portion 36 is received inside the attached portion 48. In the aforementioned receiving process, the sloping front surfaces of the projections 38 each having the first facing portion 386F are brought into abutment with a rear end of the first portion 48F. Then, the projections 38 each having the first facing portion 386F are moved forward while resiliently deforming the first portion 48F so that the first portion 48F is expanded in the radial direction of the imaginary shaft AXS. Then, the projections 38 each having the first facing portion 386F are received in the recessed portions 482. In the aforementioned receiving process, each of the projections 38 having the second facing portion 386S is received in the space such as the receiving groove 488 and the separation groove 484. The main member 30 and the sub member 40 of the housing 20 are combined as described above.

Referring to FIG. 11, in the housing 20, each of the first facing portions 386F is received in one of the recessed portions 482. Each of the thus-received first facing portions 386F is located forward of one of the opposite facing portions 486 and faces the one of the opposite facing portions 486 in the X-direction. This facing arrangement of the first facing portions 386F and the opposite facing portions 486 prevents the sub member 40 from coming off the main member 30.

Referring to FIG. 12, in the housing 20, each of the second facing portions 386S faces none of the opposite facing portions 486 in the X-direction. Instead, each of the second facing portions 386S is received in one of the receiving grooves 488 except for the second facing portions 386S each of which is received in a space other than the receiving groove 488, or the separation grooves 484 (see FIG. 5). One or more of the projections 38 each having the second facing portion 386S are received in the receiving grooves 488, respectively, so that the sub member 40 is prevented from being rotated relative to the main member 30.

Referring to FIGS. 1, 4 and 5, in the present embodiment, the main member 30 is arranged so that the cable 60 extends downward, and the sub member 40 is attached to the thus-arranged main member 30 so that the lock support portion 46 is located at an upper side of the sub member 40. In other words, the main member 30 is attached to the sub member 40 with the lock support portion 46 located at the upper side thereof while the cable 60 extends downward. However, according to the present embodiment, the main member 30 can be attached to the sub member 40 at various angles because the main member 30 is provided with the projections 38 arranged at regular intervals, and the sub member 40 is provided with the recessed portions 482 and the receiving grooves 488 which correspond to the projections 38. For example, the main member 30 can be attached to the sub member 40 with the lock support portion 46 located at the upper side thereof while the cable 60 extends in the Y-direction.

In detail, in the combination process of the main member 30 with the sub member 40, the sub member 40 can take N kinds (N is the number of the projections 38) of angles relative to the main member 30 in the circumferential direction of the imaginary shaft AXP and the imaginary shaft AXS which are equal to each other. Since the projections 38 of the present embodiment are arranged to be apart from one another by the predetermined angle CA in the circumferential direction of the imaginary shaft AXP, the extending direction of the cable 60 can be selected from N kinds of directions any two of which intersect with each other by one or more integer times of the predetermined angle CA.

The present embodiment can be further variously modified in addition to the already described modifications.

Figure 17:
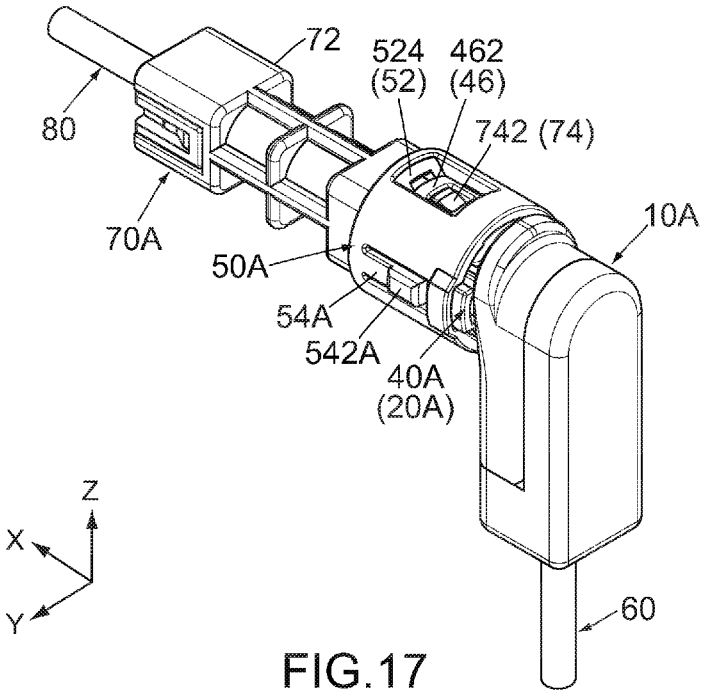
FIG. 17 is a perspective view showing a connector according to a modification of the present embodiment, wherein the connector is in a mated state where the connector is mated with a mating connector.

Referring to FIG. 17, a connector 10A according to a modification of the present embodiment is, similar to the connector 10 (see FIG. 1), mateable with a mating connector 70A along the X-direction under a state where the mating connector 70A is located forward of the connector 10A in the X-direction. Moreover, the connector 10A is removable from the mating connector 70A along the X-direction.

Figure 18:
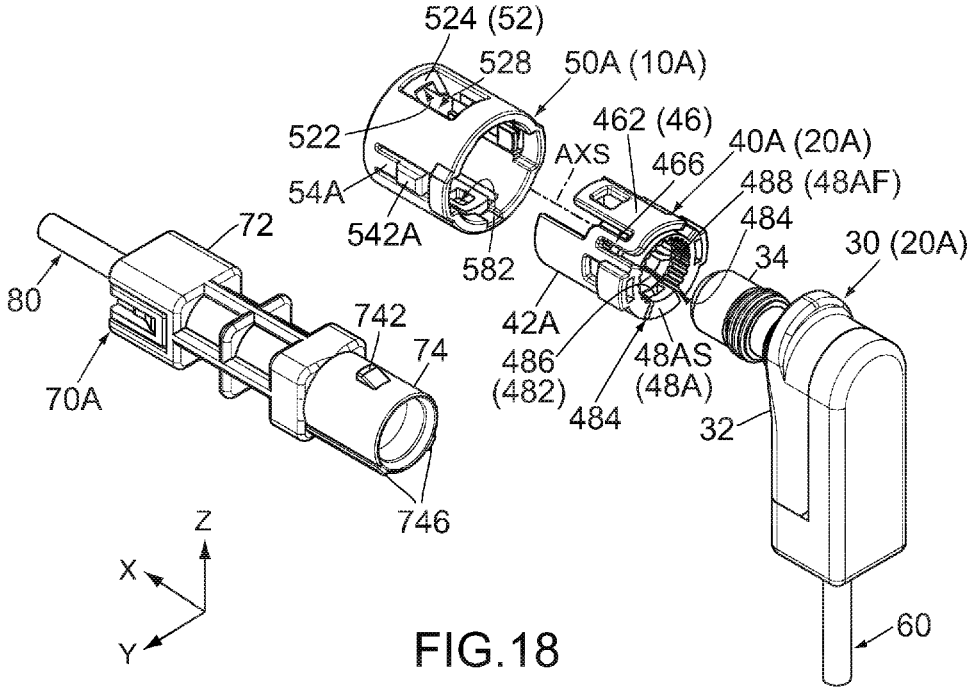
FIG. 18 is an exploded, perspective view showing the connector and the mating connector of FIG. 17, wherein an imaginary central axis of an attached portion of a sub member of the connector is illustrated by chain dotted line.

Comparing FIG. 18 with FIG. 2, the mating connector 70A has a structure same as that of the mating connector 70 except that the number of the guided portions 746 is not four but two.

Comparing FIG. 18 with FIG. 3, the connector 10A has a structure same as that of the connector 10 except that the connector 10A comprises a housing 20A and a slider 50A which are partially different from the housing 20 and the slider 50 of the connector 10, respectively. The housing 20A of the connector 10A comprises the main member 30 same as that of the housing 20 of the connector 10 while comprising a sub member 40A partially different from the sub member 40 of the housing 20. Thus, the members of the connector 10A that are different from those of the connector 10 are limited to the sub member 40A and the slider 50A each made of insulator such as resin. Hereafter, explanation will be mainly made about this difference.

Figure 19:
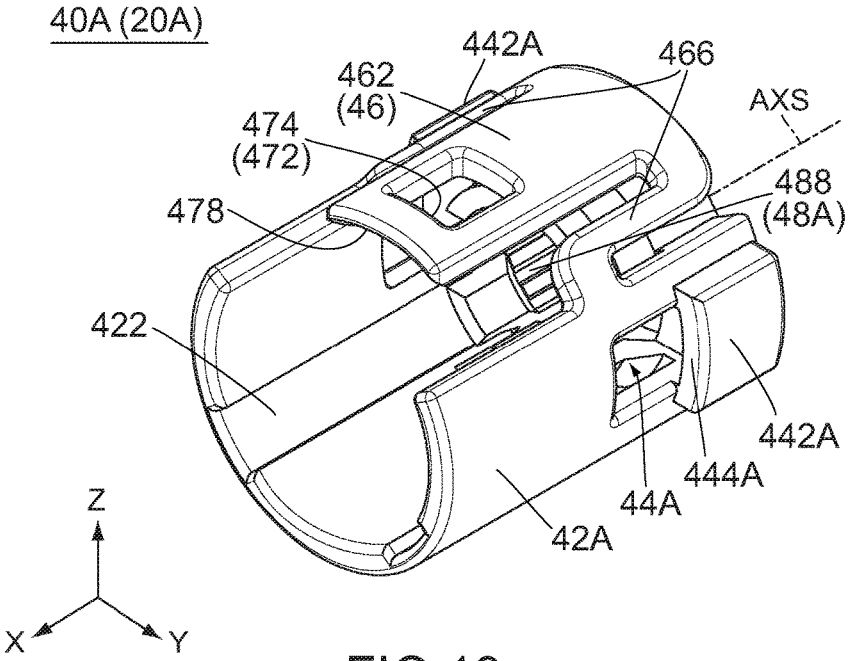
FIG. 19 is a perspective view showing the sub member of FIG. 18, wherein the imaginary central axis of the attached portion is illustrated by chain dotted line.

Comparing FIG. 19 with FIG. 5, the sub member 40A of the housing 20A has the lock support portion 46 same as that of the sub member 40 while having a peripheral wall 42A and an attached portion 48A which are different from the peripheral wall 42 and the attached portion 48 of the sub member 40, respectively. The peripheral wall 42A is formed with two passage holes 44A and two protruding portions 442A instead of the two operation support portions 44 and provided with two regulating portions 444A different from the regulating portions 444. Except for the aforementioned difference, the peripheral wall 42A has a structure same as that of the peripheral wall 42.

Referring to FIGS. 19 and 23, the two passage holes 44A are provided at opposite sides of the peripheral wall 42A in the Y-direction, respectively. Each of the passage holes 44A is located in the vicinity of a rear end of the peripheral wall 42A and passes through the peripheral wall 42A in the Y-direction. The two protruding portions 442A are provided so as to correspond to the passage holes 44A, respectively. More specifically, each of the two protruding portions 442A is located rearward of the corresponding passage hole 44A and protrudes outward in the Y-direction. Each of the regulating portions 444A is a front surface of the protruding portion 442A and is located rearward of the corresponding passage hole 44A in the X-direction. Each of the regulating portions 444A is a vertical surface perpendicular to the X-direction and projects outward in the Y-direction from the passage hole 44A.

Figure 20:
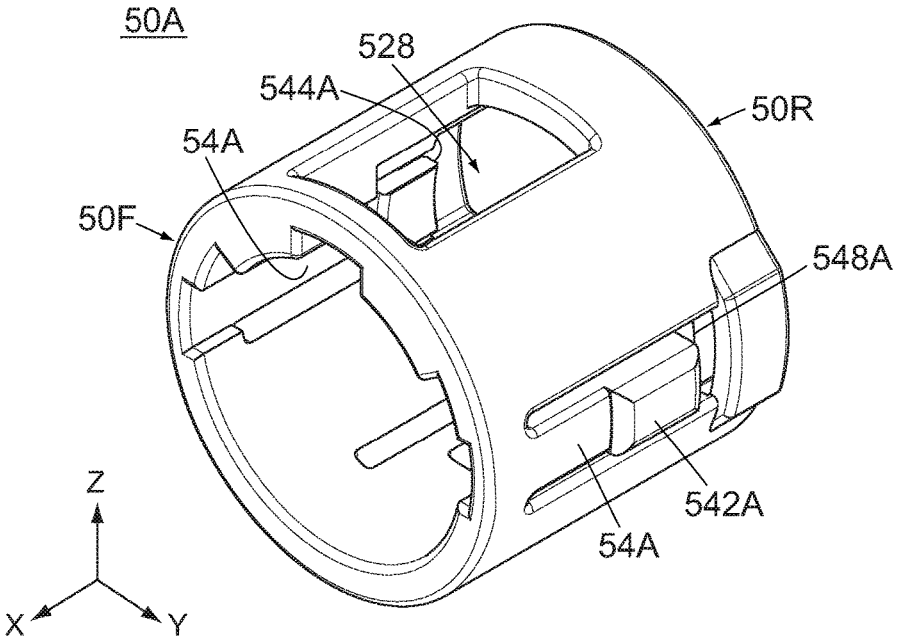
FIG. 20 is a perspective view showing a slider of the connector of FIG. 18.

Comparing FIGS. 18 and 20 with FIG. 6, the slider 50A is formed with none of the two passage holes 56. Instead, the slider 50A has two operation support portions 54A. Except for the aforementioned difference, the slider 50A has a structure same as that of the slider 50.

Referring to FIGS. 20 and 23, the two operation support portions 54A are located at opposite sides of the slider 50A in the Y-direction, respectively. Each of the operation support portions 54A is provided with an operation portion 542A, a regulated portion 544A and a release ramp 548A. In other words, the slider 50A has two sets each consisting of the operation portion 542A, the regulated portion 544A and the release ramp 548A.

Each of the operation support portions 54A extends along the X-direction and is resiliently deformable. In detail, each of the operation support portions 54A of the present modification has a front end connected to a front end part of the slider 50A and is supported by the front end part of the slider 50A in a cantilever manner. In each of the operation support portions 54A of the present modification, the front end is a fixed end, and a rear end is a free end.

When each of the operation support portions 54A is resiliently deformed, the operation portion 542A, the regulated portion 544A and the release ramp 548A are moved mainly in the Y-direction. In detail, each of the operation portions 542A is movable about a fulcrum, or the front end (fixed end) of the operation support portion 54A. In other words, the operation portion 542A is operable so as to be moved along an operation direction intersecting with the X-direction, or a pivoting direction about the fixed end of the operation support portion 54A. Each of the regulated portion 544A and the release ramp 548A is moved along the operation direction in accordance with a movement of the operation portion 542A along the operation direction. In other words, each of the operation portions 542A, the regulated portions 544A and the release ramps 548A is supported by the corresponding operation support portion 54A to be movable in the operation direction.

According to the present modification, the operation portion 542A is located nearer to the rear end of the operation support portion 54A beyond the middle of the operation support portion 54A in the X-direction and projects outward in the Y-direction from the operation support portion 54A. The regulated portion 544A is a rear end surface of the operation portion 542A and is a vertical surface perpendicular to the X-direction when the operation portion 542A is not resiliently deformed. The release ramp 548A is a plane which is oblique to both the X-direction and the Y-direction and which is in parallel to the Z-direction. The release ramp 548A is a chamfered edge which is an outside edge of the rear end surface of the operation support portion 54A in the Y-direction. In other words, the release ramp 548A is located outward of the regulated portion 544A both in the Y-direction and in the operation direction.

Figure 21:
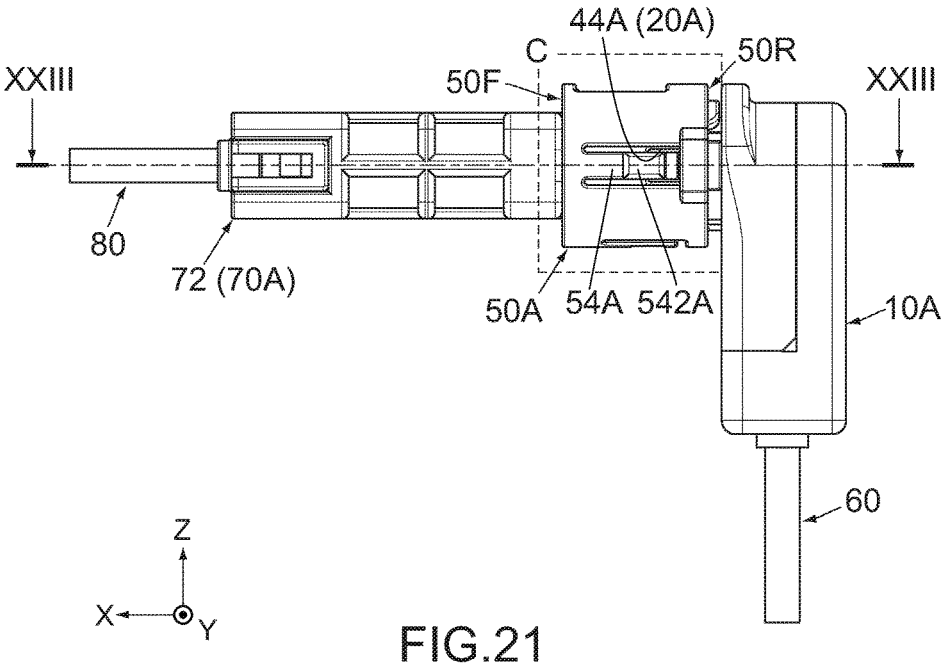
FIG. 21 is a side view showing the connector of FIG. 17.

Referring to FIGS. 21 and 23, the two passage holes 44A of the housing 20A are provided so as to correspond to the two operation support portions 54A of the slider 50A, respectively. Each of the operation support portions 54A has a rear end part which includes the regulated portion 544A, and an inside part of the rear end part in the Y-direction is located inside the corresponding passage hole 44A. Each of the regulated portions 544A is movable into the corresponding passage hole 44A along the operation direction.

Referring to FIG. 23, the regulated portions 544A of the slider 50A are arranged so as to correspond to the regulating portions 444A of the housing 20A, respectively. More specifically, under the mated state, each of the regulating portions 444A is slightly apart from and is located rearward of the corresponding regulated portion 544A and faces the corresponding regulated portion 544A in a release direction (negative X-direction). The thus-arranged regulating portions 444A regulate a movement of the slider 50A along the release direction. The position of the thus-located regulated portion 544A, or the position shown in FIG. 23, is referred to as a regulation position. Thus, the regulated portions 544A face the regulating portions 444A in the release direction, respectively, when the regulated portions 544A are located at the regulation position.

Figure 25:
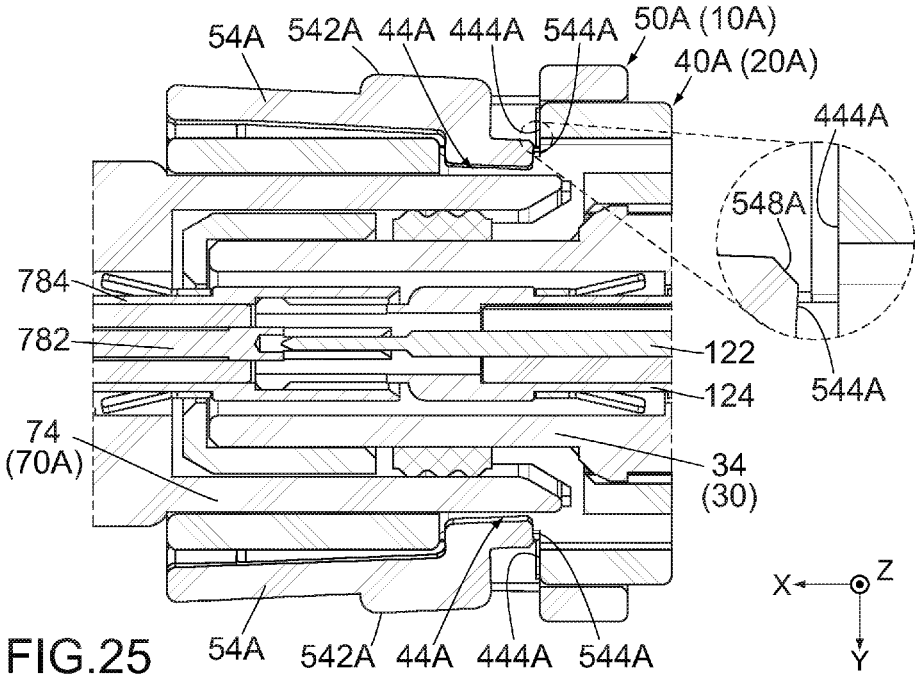
FIG. 25 is a cross-sectional view showing the connector of FIG. 23, wherein an operation portion is operated to be pressed, and the regulating portion, the regulated portion and therearound (parts enclosed by dashed line) are enlarged to be illustrated.

Referring to FIGS. 23 and 25, when each of the operation portions 542A is operated to be pressed inward of the connector 10A in the operation direction, the regulated portion 544A is moved inward of the connector 10A and is moved to a non-regulation position, or the position shown in FIG. 25, along the operation direction.

Referring to FIG. 25, when each of the regulated portions 544A is located at the non-regulation position, the regulated portion 544A does not face the corresponding regulating portion 444A in the release direction (negative X-direction). Therefore, the slider 50A can be moved in the release direction without abutment of the regulated portions 544A with the regulating portions 444A. In other words, when the operation portions 542A are operated to be pressed inward of the connector 10A in the operation direction, the regulating portions 444A do not regulate the movement of the slider 50A. In the present modification, the operation support portions 54A support the regulated portions 544A, respectively, so that each of the regulated portions 544A is movable between the regulation position and the non-regulation position in accordance with the movement of the operation portion 542A.

Figure 22:
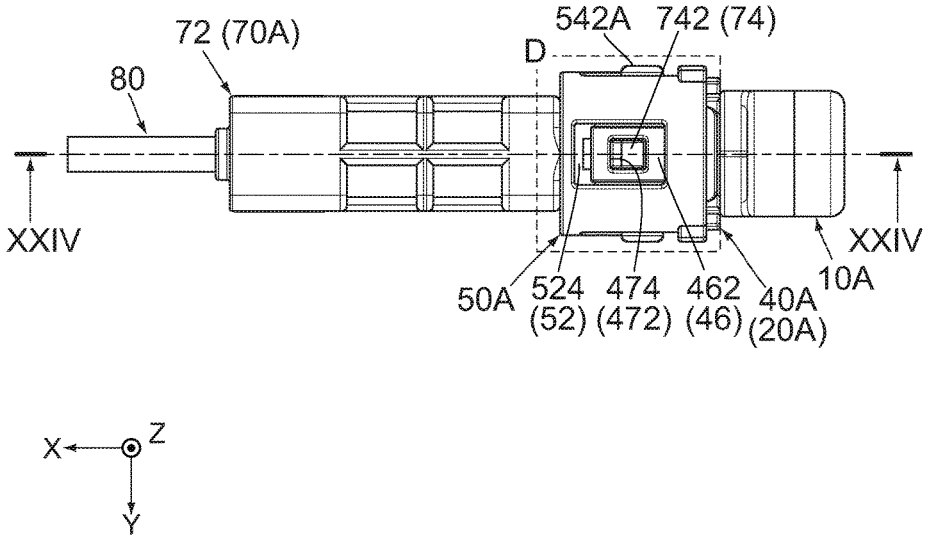
FIG. 22 is a top view showing the connector of FIG. 17.
Figure 26:
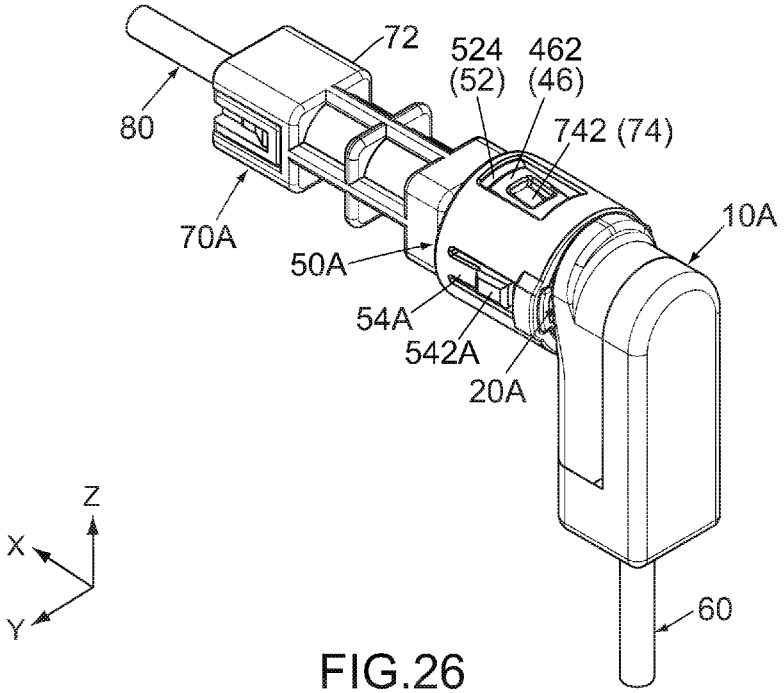
FIG. 26 is a perspective view showing the connector of FIG. 17, wherein the slider is moved rearward.
Figure 27:
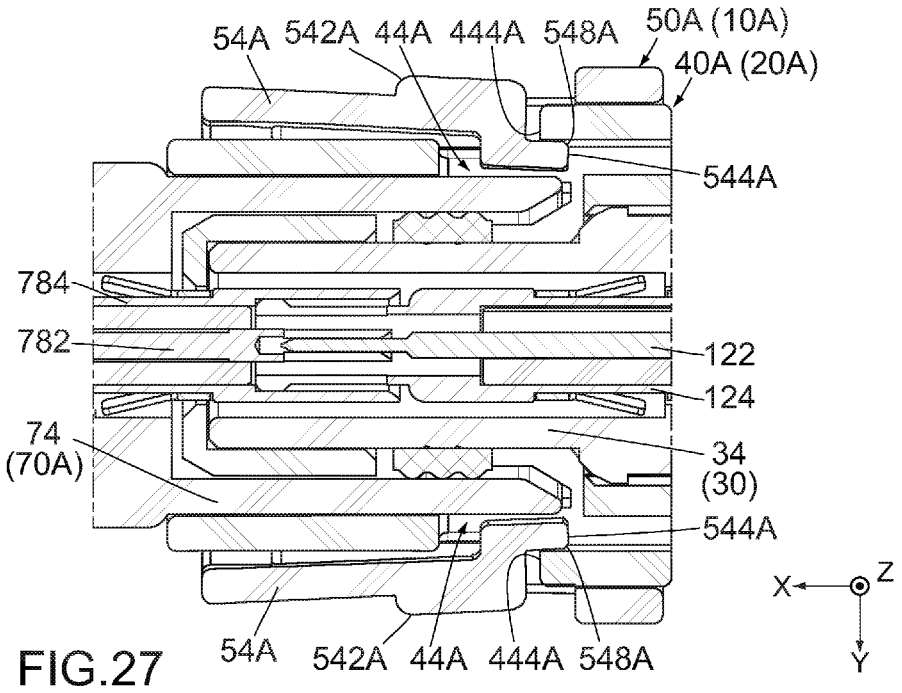
FIG. 27 is a cross-sectional view showing the connector of FIG. 23, wherein the slider is moved rearward.
Figure 28:
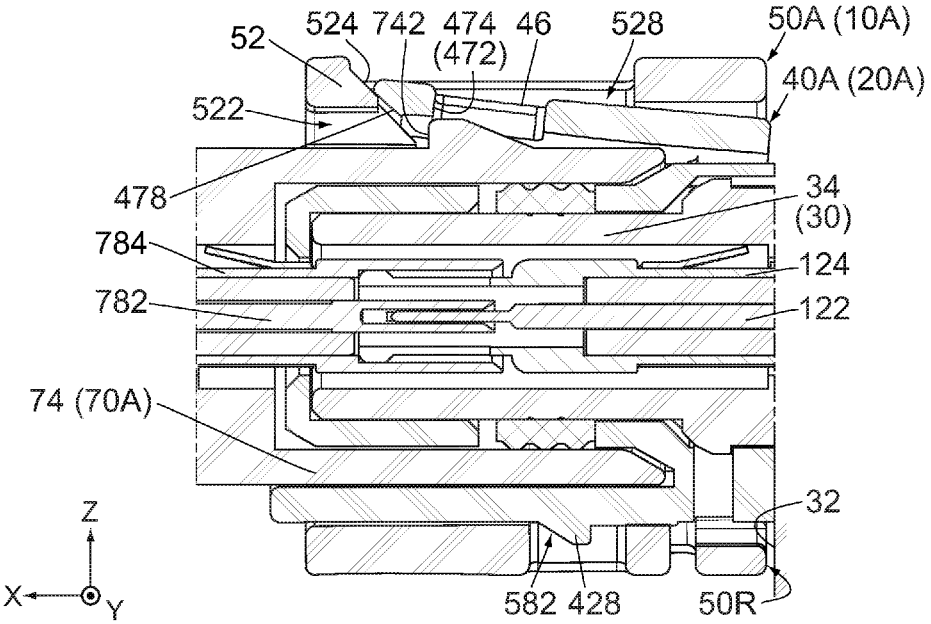
FIG. 28 is a cross-sectional view showing the connector of FIG. 24, wherein the slider is moved rearward.
Figure 29:
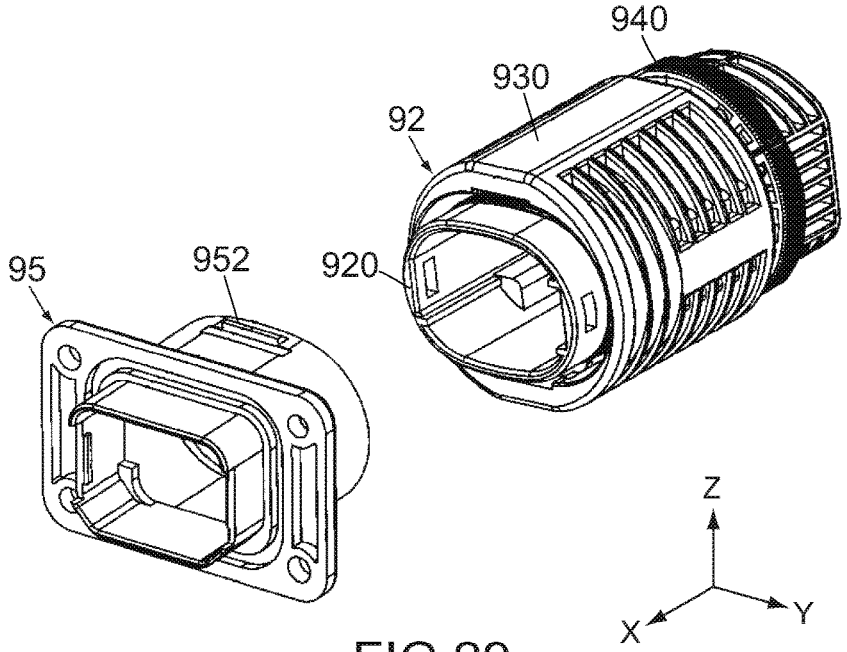
FIG.29 PRIOR ART
FIG. 29 is a perspective view showing a connector and a mating connector according to a first embodiment of Patent Document 1, wherein the connector is apart from the mating connector.
Figure 30:
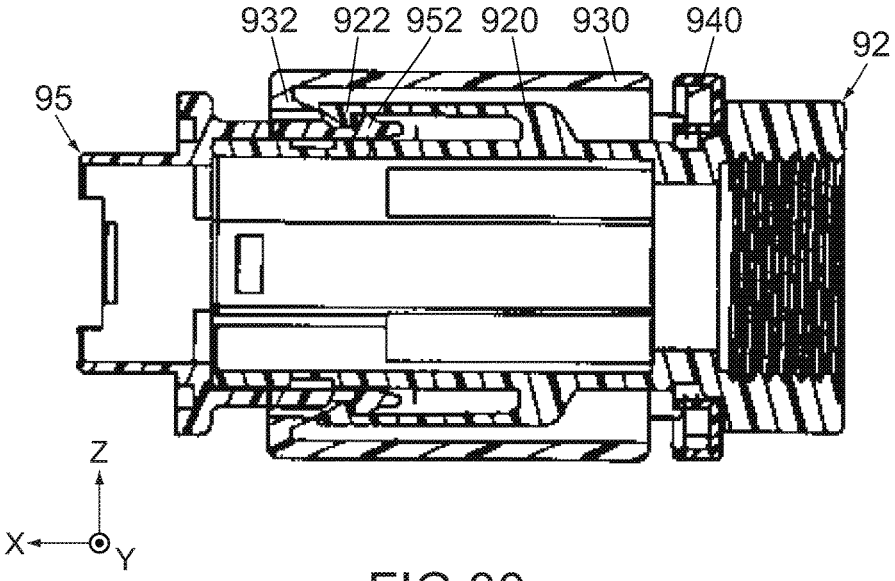
FIG.30 PRIOR ART
FIG. 30 is a cross-sectional view showing the connector and the mating connector o FIG. 29, wherein the connector is mated with the mating connector, and the mating connector is locked.
Figure 31:
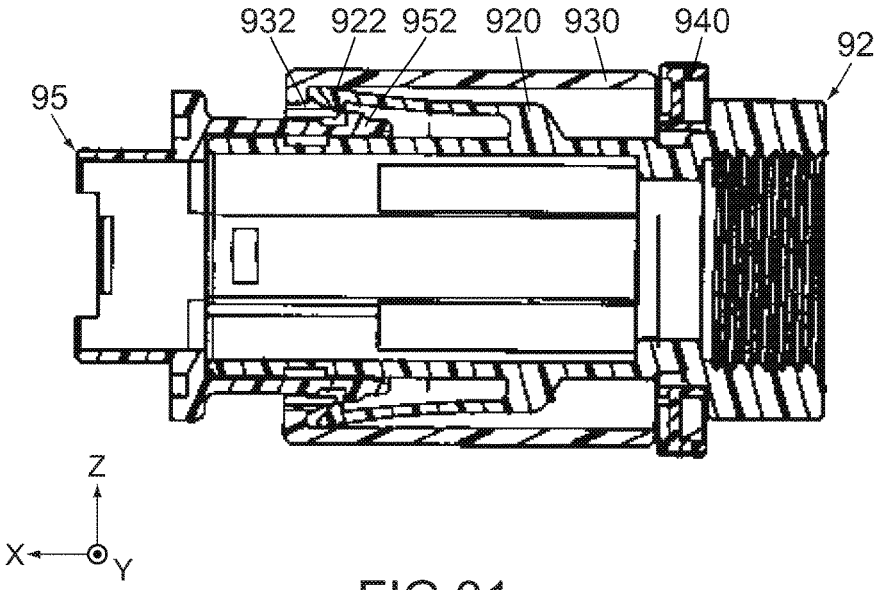
FIG.31 PRIOR ART
FIG. 31 is a cross-sectional view showing the connector and the mating connector o FIG. 30, wherein the mating connector is released.

Referring to FIGS. 22 and 24, the mating lock portion 742 of the mating connector 70A is locked by the lock portion 474 of the housing 20A under the mated state. Referring to FIGS. 26 to 28, when the slider 50A is moved in the release direction (negative X-direction) subsequent to the cancellation of the movement regulation of the slider 50A by the pressing operation of the operation portions 542A, the mating lock portion 742 can be released. Since the pressing direction in the pressing operation of the operation portions 542A is directed inward of the connector 10A, the slider 50A can be held at the same time of the pressing operation. Therefore, the mating lock portion 742 can be released by a continuous, smooth operation in which the slider 50A is held by the pressing operation of the operation portions 542A and the thus-held slider 50A is moved in the release direction together with the operation portions 542A.

According to the present modification, operability of removal operation of the connector 10A from the mating connector 70A can be improved. Referring to FIG. 21, in the connector 10A, each of the operation portions 542A is located between the front end 50F and the rear end 50R of the slider 50A in the X-direction. Referring to FIGS. 7 and 21, the thus-formed slider 50A is easily operable similar to the slider 50. In addition, the operation portions 542A of the connector 10A are provided to the slider 50A. Referring to FIGS. 1 and 17, the slider 50A is more easily operable in comparison with the slider 50 of the connector 10 in which the operation portions 442 are provided to the housing 20.

Referring to FIG. 28, when the slider 50A is moved in the release direction (negative X-direction) and releases the mating lock portion 742 of the mating connector 70A, the lock support portion 46 of the housing 20A is resiliently deformed and presses the pressing ramp 478 against the pressed ramp 524 of the slider 50A. Referring to FIG. 28 together with FIG. 27, when the pressing operation of the operation portions 542A is stopped under this state after the removal of the connector 10A from the mating connector 70A, the slider 50A is moved forward by a forward force applied from the pressing ramp 478.

Referring to FIGS. 25 and 27, as the slider 50A is moved forward, a predetermined edge of each of the regulating portions 444A, which is located at an inside part of the regulating portion 444A in the Y-direction, slides on an outer surface of a rear end part of the operation support portion 54A in the Y-direction and approaches the release ramp 548A. The release ramp 548A, which is located outward of the regulated portion 544A in the operation direction, is brought into contact with the predetermined edge of the regulating portion 444A when the slider 50A is moved forward by a predetermined distance. At that time, the release ramp 548A applies a force caused by a restoring force of the operation support portion 54A to the predetermined edge of the regulating portion 444A, so that the release ramp 548A receives a reaction force from the predetermined edge of the regulating portion 444A. As a result, the slider 50A receives additional forward force at the release ramp 548A and is further moved forward.

Referring to FIGS. 27 and 28, according to the present modification, when the pressing operation of the operation portions 542A is merely stopped, the slider 50A, which has been moved in the release direction (negative X-direction), returns to its initial position, or the position shown in FIGS. 17 and 21 to 24, by the force applied to the pressed ramp 524 and the release ramps 548A. In particular, since the slider 50A of the present modification receives the force applied to the two release ramps 548A, the slider 50A more certainly returns to the initial position.

Comparing FIGS. 18 and 19 with FIG. 5, the attached portion 48A of the sub member 40A according to the present modification has, as a whole, a cylindrical shape about a central axis, or the imaginary shaft AXS in parallel to the X-direction, similar to the attached portion 48 of the sub member 40. In addition, the attached portion 48A works similar to the attached portion 48. However, the arrangement of the recessed portion 482 and the receiving grooves 488 of the attached portion 48A is different from that of the attached portion 48. Hereafter, explanation will be mainly made about this difference.

Referring to FIGS. 18 and 19, the attached portion 48A is not formed with the two recessed portions 482 but is formed with the one recessed portion 482 and a plurality of the receiving grooves 488. The recessed portion 482 and the receiving grooves 488 are formed in an inner circumferential surface of the attached portion 48A and arranged in the circumferential direction of the imaginary shaft AXS.

Referring to FIG. 18, the attached portion 48A is separated into a first portion 48AF and a second portion 48AS by the two separation grooves 484. Referring to FIG. 18 together with FIG. 5, the first portion 48AF and the second portion 48AS has shapes similar to the first portion 48F and the second portion 48S of the attached portion 48, respectively. However, the first portion 48AF is formed only with the receiving grooves 488, and the second portion 48AS is formed only with the one recessed portion 482. Referring to FIG. 18, the recessed portion 482 is a hole which passes through the attached portion 48A in the radial direction of the imaginary shaft AXS. The recessed portion 482 has the rear inner surface which works as the opposite facing portion 486.

Referring to FIGS. 4, 18 and 19, when the main member 30 is arranged rearward of the sub member 40A under a state where the imaginary shaft AXP is equal to the imaginary shaft AXS and a predetermined one of the projections 38 is located right behind one of the receiving grooves 488, the facing portions 386 of the projections 38 are grouped into the first facing portions 386F located right behind the recessed portion 482 and the second facing portions 386S each of which is located right behind the space such as the receiving groove 488 and the separation groove 484. In other words, the facing portions 386 include one or more of the first facing portions 386F and one or more of the second facing portions 386S.

When the main member 30 is moved forward under the aforementioned arrangement in which the main member 30 is arranged rearward of the sub member 40A, the attachment portion 36 is received inside the attached portion 48A. In the aforementioned receiving process, the sloping front surfaces of the projections 38 each having the first facing portion 386F are brought into abutment with a rear end of the second portion 48AS. Then, the projections 38 each having the first facing portion 386F are moved forward while resiliently deforming the second portion 48AS so that the second portion 48AS is moved in the radial direction of the imaginary shaft AXS. Then, the projections 38 each having the first facing portion 386F are received in the recessed portion 482. In the aforementioned receiving process, each of the projections 38 having the second facing portion 386S is received in the space such as the receiving groove 488 and the separation groove 484. The main member 30 and the sub member 40A of the housing 20A are combined as described above.

According to the present modification, each of the first facing portions 386F is received in the recessed portion 482. Each of the thus-received first facing portions 386F is located forward of the opposite facing portion 486 and faces the opposite facing portion 486 in the X-direction. This facing arrangement of the first facing portions 386F and the opposite facing portion 486 prevents the sub member 40A from coming off the main member 30. Moreover, each of the second facing portions 386S does not face the opposite facing portion 486 in the X-direction. Instead, each of the second facing portions 386S is received in one of the receiving grooves 488 except for the second facing portions 386S each of which is received in a space other than the receiving groove 488, or the separation groove 484. One or more of the projections 38 each having the second facing portion 386S are received in the receiving grooves 488, respectively, so that the sub member 40A is prevented from being rotated relative to the main member 30.

The projections 38 in the present modification are, similar to the previously described embodiment, arranged to be apart from one another by the predetermined angle CA in the circumferential direction of the imaginary shaft AXP. Therefore, the extending direction of the cable 60 can be selected from N kinds (N is the number of the projections 38) of directions any two of which intersect with each other by one or more integer times of the predetermined angle CA.

The embodiment and the modification described above can be further variously modified. Hereafter, explanation will be made about some modifications.

Referring to FIGS. 11 and 23, the housing 20 of the connector 10 is provided with the regulating portions 444, and the housing 20A of the connector 10A is provided with the regulating portions 444A. However, the regulating portions may be provided to a member other than the housing.

The housing 20 of the connector 10 is provided with the operation portions 442, while the slider 50A of the connector 10A is provided with the operation portions 542A. However, the operation portions may be provided to a member other than the housing and the slider.

Referring to FIGS. 9 and 22, when the pressed ramp 524 is seen along the Z-direction, the pressed ramp 524 may have a shape different from the U-like shape. For example, when the pressed ramp 524 is seen along the Z-direction, the pressed ramp 524 may have an L-like shape. More specifically, referring to FIGS. 9 and 22 together with FIGS. 12 and 24, the whole of the passage channel 522 may be a recess which is provided to the release portion 52 and recessed downward from the pressed ramp 524. According to this structure, the pressed ramp 524 is formed of two sloping surfaces which are located at opposite sides of the passage channel 522 in the Y-direction, respectively. Each of these two sloping surfaces has an L-like shape when seen along the Z-direction.

Referring to FIGS. 5 and 18, each of the attached portion 48 and the attached portion 48A may be formed with one or more of the recessed portions 482. In other words, each of the sub member 40 and the sub member 40A may have one or more of the opposite facing portions 486. Moreover, referring to FIGS. 5 and 18 together with FIG. 4, the number of the projections 38 received in one of the recessed portions 482 is not limited. However, from a view point of securely preventing the sub member 40 (sub member 40A) from coming off the main member 30, the number of the recessed portions 482 is preferred to be two or more, and the number of the projections 38 received in each of the recessed portions 482 is preferred to be two or more.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector having a mating lock portion along a front-rear direction under a state where the mating connector is located forward of the connector in the front-rear direction, wherein:

the connector comprises a contact, a housing, a slider, a regulating portion and an operation portion;

the contact is held by the housing;

the housing has a lock portion;

the lock portion is supported to be movable between a lock position and a release position;

under a mated state where the connector is mated with the mating connector, the lock portion is located at the lock position and locks the mating lock portion of the mating connector;

the slider is attached to the housing to be movable in the front-rear direction;

the slider has a release portion and a regulated portion;

when the slider is moved in a release direction in parallel to the front-rear direction under the mated state, the release portion moves the lock portion from the lock position to the release position and releases the mating lock portion;

under the mated state, the regulating portion faces the regulated portion in the release direction and regulates a movement of the slider along the release direction; and when the operation portion is operated to be pressed inward of the connector in an operation direction intersecting with the front-rear direction, at least one of the regulating portion and the regulated portion is moved, and the regulating portion does not regulate the movement of the slider.

2. The connector as recited in claim 1, wherein the operation portion is located between a front end and a rear end of the slider in the front-rear direction.

3. The connector as recited in claim 1, wherein the release direction is a rearward direction in the front-rear direction.

4. The connector as recited in claim 1, wherein the housing is provided with each of the regulating portion and the operation potion.

5. The connector as recited in claim 4, wherein:

the housing has an operation support portion;

the operation support portion is resiliently deformable;

the operation portion is supported by the operation support portion to be movable;

the regulating portion is supported by the operation support portion to be movable between a regulation position and a non-regulation position in accordance with a movement of the operation portion; and the regulating portion faces the regulated portion in the release direction when the regulating portion is located at the regulation position but does not face the regulated portion in the release direction when the regulating portion is located at the non-regulation position.

6. The connector as recited in claim 5, wherein:

the housing has a release ramp; and the release ramp is supported by the operation support portion and located outward of the regulating portion in the operation direction.

7. The connector as recited in claim 1, wherein:

the housing has a lock support portion;

the lock support portion is resiliently deformable; and the lock portion is supported by the lock support portion to be movable between the lock position and the release position.

8. The connector as recited in claim 7, wherein:

the lock support portion has a receiving portion;

the receiving portion is recessed in a perpendicular direction perpendicular to the front-rear direction and, at least in part, receives the mating lock portion under the mated state;

the receiving portion has a front inner surface that works as the lock portion;

the lock support portion has a front end formed with a pressing ramp;

the slider is formed with a passage channel and a pressed ramp;

the passage channel allows the lock portion to be moved therethrough along the front-rear direction;

the pressed ramp has an L-like or U-like shape when seen along the perpendicular direction; and the passage channel has a rear end which is located at a position same as that of a rear end of the pressed ramp in the front-rear direction.

9. The connector as recited in claim 8, wherein when the lock portion is located at the lock position, the pressing ramp and the pressed ramp partially face each other in the front-rear direction.

10. The connector as recited in claim 7, wherein:

the lock support portion has a plate-like portion and two spring portions;

each of the spring portions has a bent portion, a first end connected to the plate-like portion and a second end connected to a part other than the plate-like portion of the housing; and the first end and the second end of each of the spring portions are located at positions different from each other in the front-rear direction.

11. The connector as recited in claim 1, wherein:

the housing comprises a main member and a sub member;

the main member holds the contact and has facing portions;

the sub member is attached to a front side of the main member and has one or more opposite facing portions;

the facing portions include one or more first facing portions and one or more second facing portions;

each of the first facing portions is located forward of one of the opposite facing portions and faces the one of the opposite facing portions in the front-rear direction; and each of the second facing portions faces none of the opposite face portions in the front-rear direction.

12. The connector as recited in claim 11, wherein:

the main member is formed with projections;

each of the projections has a rear surface that works as the facing portion;

the sub member has an attached portion;

the attached portion is formed with one or more recessed portions;

each of the recessed portions has a rear inner surface that works as the opposite facing portion; and each of the first facing portions is received in one of the recessed portions.

* * * * *